US007461580B2

(12) United States Patent
Bell et al.

(10) Patent No.: US 7,461,580 B2
(45) Date of Patent: Dec. 9, 2008

(54) CASING CONVEYED WELL PERFORATING APPARATUS AND METHOD

(75) Inventors: Matthew Robert George Bell, Houston, TX (US); Christopher Burres, Houston, TX (US); Aron Ekelund, Houston, TX (US)

(73) Assignee: Shell Oil Company, Houston, TX (US)

( * ) Notice: Subject to any disclaimer, the term of this patent is extended or adjusted under 35 U.S.C. 154(b) by 374 days.

(21) Appl. No.: 10/840,589

(22) Filed: May 6, 2004

(65) Prior Publication Data

US 2004/0206503 A1 Oct. 21, 2004

Related U.S. Application Data

(63) Continuation-in-part of application No. 10/339,225, filed on Jan. 9, 2003, now Pat. No. 6,962,202.

(51) Int. Cl.
*E21B 43/1185* (2006.01)

(52) U.S. Cl. ..... 89/1.15; 175/4.55

(58) Field of Classification Search ..... 89/1.15; 166/313; 175/4.55
See application file for complete search history.

(56) References Cited

U.S. PATENT DOCUMENTS

| | | | | |
|---|---|---|---|---|
| 25,011 | A | 8/1859 | Harrah et al. | |
| 88,620 | A | 4/1869 | Friedmann | |
| 2,551,031 | A * | 5/1951 | McCullough | 175/4.58 |
| 2,667,836 | A | 2/1954 | Church et al. | |
| 2,837,027 | A | 6/1958 | Martin | |
| 2,946,283 | A * | 7/1960 | Udry | 175/4.5 |
| 2,955,533 | A * | 10/1960 | Martinez, Jr. | 102/318 |
| 3,276,371 | A | 10/1966 | Newman et al. | |
| 3,351,012 | A | 11/1967 | Wilson | |
| 3,468,386 | A | 9/1969 | Johnson | |
| 3,734,018 | A | 5/1973 | Gillingham | 102/20 |
| 3,735,705 | A | 5/1973 | Hudson, Jr. et al. | |
| 3,830,303 | A | 8/1974 | Perkins | 166/297 |

(Continued)

FOREIGN PATENT DOCUMENTS

EP 0694157 B1 8/2001

(Continued)

OTHER PUBLICATIONS

Baker, Ron, "A Primer of Oilwell Drilling," Fourth Edition, First Edition published 1951, Fourth Edition published 1979, pp. 59-61, 68-71, The University of Texas at Austin.

(Continued)

*Primary Examiner*—Stephen M Johnson

(57) ABSTRACT

Disclosed is a casing conveyed perforating system and methods for externally perforating a wellbore and casing. The perforating system is attached to the outside of the casing and is conveyed along with the casing when it is inserted into the wellbore. The perforation may be accomplished using two groups of charges, which are contained in protective pressure chambers, however, may use only one group of bi-directional charges. Each pressure chamber may be positioned radially around the outside of the wellbore casing. The pressure chambers form longitudinally extending ribs, which conveniently serve to center the casing within the wellbore. One group of charges may be aimed inward in order to perforate the casing, while the other group of charges is aimed outward in order to perforate the formation.

25 Claims, 18 Drawing Sheets

U.S. PATENT DOCUMENTS

| | | | | |
|---|---|---|---|---|
| 4,140,188 | A | 2/1979 | Vann | 175/4.51 |
| 4,371,044 | A | 2/1983 | Willig et al. | 175/4.6 |
| 4,391,337 | A | 7/1983 | Ford et al. | 175/4.6 |
| 4,485,741 | A | 12/1984 | Moore et al. | 102/331 |
| 4,496,009 | A | 1/1985 | DerMott et al. | 175/4.52 |
| 4,538,680 | A | 9/1985 | Brieger et al. | 166/55 |
| 4,576,093 | A | 3/1986 | Snyder | 102/200 |
| 4,615,268 | A | 10/1986 | Nakano et al. | 102/217 |
| 4,619,333 | A | 10/1986 | George | 175/4.52 |
| 4,649,822 | A | 3/1987 | Seeman | 102/275.1 |
| 4,768,597 | A | 9/1988 | Lavigne et al. | 175/451 |
| 4,775,878 | A | 10/1988 | Inoue et al. | 357/22 |
| 4,790,383 | A | 12/1988 | Savage et al. | 166/297 |
| 4,850,438 | A | 7/1989 | Regalbuto | 175/4.56 |
| 4,884,506 | A | 12/1989 | Guerreri | 102/200 |
| 4,895,218 | A | 1/1990 | Chen et al. | 181/116 |
| 4,911,251 | A | 3/1990 | George et al. | 175/4.54 |
| 4,917,187 | A | 4/1990 | Burns et al. | 166/297 |
| 4,924,952 | A | 5/1990 | Schneider | 175/4.54 |
| 4,951,744 | A | 8/1990 | Rytlewski | 175/4.57 |
| 4,969,525 | A | 11/1990 | George et al. | 166/297 |
| 5,031,517 | A | 7/1991 | Yeh | 99/319 |
| 5,038,682 | A | 8/1991 | Marsden | 102/220 |
| 5,050,672 | A | 9/1991 | Huber et al. | 166/55 |
| 5,090,321 | A | 2/1992 | Abouav | 102/200 |
| 5,111,885 | A | 5/1992 | Umphries | 166/297 |
| 5,131,465 | A | 7/1992 | Langston | 166/55.1 |
| 5,159,149 | A | 10/1992 | Marsden | 102/217 |
| 5,212,495 | A | 5/1993 | Winkel et al. | 343/872 |
| 5,224,556 | A | 7/1993 | Wilson et al. | 175/4.53 |
| 5,279,228 | A | 1/1994 | Ayer | 102/306 |
| 5,287,924 | A * | 2/1994 | Burleson et al. | 166/297 |
| 5,295,544 | A | 3/1994 | Umphries | 166/297 |
| 5,355,957 | A | 10/1994 | Burleson et al. | 166/297 |
| 5,413,045 | A | 5/1995 | Miszewski | 102/201 |
| 5,423,382 | A | 6/1995 | Barton et al. | 166/297 |
| 5,436,791 | A | 7/1995 | Turano et al. | 361/253 |
| 5,445,228 | A | 8/1995 | Rathmell et al. | 175/4 |
| 5,467,823 | A | 11/1995 | Babour et al. | 166/250.01 |
| 5,479,860 | A | 1/1996 | Ellis | 102/313 |
| 5,505,134 | A | 4/1996 | Brooks et al. | 102/203.7 |
| 5,513,703 | A | 5/1996 | Mills et al. | 166/55.1 |
| 5,530,358 | A | 6/1996 | Wisler et al. | 324/338 |
| 5,660,232 | A | 8/1997 | Reinhardt | 166/297 |
| 5,706,892 | A | 1/1998 | Aeschbacher, Jr. et al. | 166/66 |
| 5,765,641 | A | 6/1998 | Shy et al. | 166/292 |
| 5,767,437 | A | 6/1998 | Rogers | 102/200 |
| 5,807,302 | A | 9/1998 | Wandel | 604/8 |
| 5,829,538 | A | 11/1998 | Wesson et al. | 175/4.6 |
| 5,943,954 | A | 8/1999 | Otomo | 101/120 |
| 5,995,449 | A | 11/1999 | Green et al. | 367/83 |
| 6,009,947 | A | 1/2000 | Wilson et al. | 166/299 |
| 6,082,450 | A | 7/2000 | Snider et al. | 166/55.2 |
| 6,085,843 | A | 7/2000 | Edwards et al. | 166/297 |
| 6,234,081 | B1 | 5/2001 | Neyer | 102/202.5 |
| 6,247,408 | B1 | 6/2001 | Andrejkovies et al. | 102/200 |
| 6,386,108 | B1 | 5/2002 | Brooks et al. | 102/217 |
| 6,386,288 | B1 | 5/2002 | Snider et al. | 166/298 |
| 6,464,011 | B2 | 10/2002 | Tubel | 166/313 |
| 6,536,524 | B1 | 3/2003 | Snider | 166/297 |
| 6,536,624 | B2 | 3/2003 | Johnson et al. | 221/45 |
| 6,557,636 | B2 | 5/2003 | Cernocky et al. | 166/297 |
| 6,577,244 | B1 | 6/2003 | Clark et al. | 340/854.6 |
| 6,702,039 | B2 | 3/2004 | Parrott et al. | 175/4.6 |
| 6,710,600 | B1 | 3/2004 | Kopecki et al. | 324/338 |
| 6,752,083 | B1 | 6/2004 | Lerche et al. | 102/202.7 |
| 6,755,249 | B2 | 6/2004 | Robison et al. | 166/262 |
| 2002/0088620 | A1 | 7/2002 | Lerche et al. | 166/297 |
| 2002/0125011 | A1 | 9/2002 | Snider et al. | 166/297 |
| 2003/0000411 | A1 | 1/2003 | Cernocky et al. | 102/200 |
| 2003/0000703 | A1 | 1/2003 | Cernocky et al. | 166/297 |
| 2003/0001753 | A1 | 1/2003 | Cernocky et al. | 340/853.1 |
| 2005/0109508 | A1 | 5/2005 | Vella et al. | 166/297 |

FOREIGN PATENT DOCUMENTS

| | | |
|---|---|---|
| FR | 2688583 | 9/1993 |
| JP | 5149700 | 6/1993 |
| RU | 2001250 C1 | 10/1993 |
| SU | 1657627 A1 | 6/1991 |
| WO | WO9508866 | 3/1995 |
| WO | WO9524608 | 9/1995 |
| WO | WO 00/05774 | 2/2000 |
| WO | WO 00/65195 | 11/2000 |

OTHER PUBLICATIONS

Perdue, Jeanne, "Well Construction: Thinking outside the casing, " Feb. 2002, pp. 1-5, Hart's E&P Net (Chemical Week Associates, New York, New York).

Rustad, Barry, et al., "Casing-conveyed perforating tested," Feb. 2000, pp. 85-87, Drilling and Bit Technology, Hart's E&P Net, www.EandPnet.com.

Shell International Exploration and Production brochure, "Leaving Fewer Footprints," Dec. 1, 2002, pp. 1-12.

* cited by examiner

CASING CONVEYED WELL PERFORATING APPARATUS AND METHOD

CROSS-REFERENCE TO RELATED APPLICATIONS

This application is a continuation in part of U.S. application Ser. No. 10/339,225 filed on Jan. 9, 2003 and issued as U.S. Pat. No. 6,962,202, which is incorporated herein by reference. Applicants, therefore, claim priority based on the filing date of U.S. application Ser. No. 10/339,225.

STATEMENT REGARDING FEDERALLY SPONSORED RESEARCH OR DEVELOPMENT

None.

BACKGROUND OF THE INVENTION

1. Field of the Invention

The present invention relates to a method and apparatus for perforating the walls of a wellbore and, in particular, to a method and apparatus which will provide accurate and controlled perforating of a tubular casing during the process of creating a subterranean well. More specifically, a perforating assembly is deployed along with the casing to be used for the perforation and stimulation of zones for the ultimate withdrawal of hydrocarbons therefrom or injection of fluids (liquid or gas) for the purpose of voidage replacement or stimulation of the production interval wherein said perforating assembly comprises a frame supporting a plurality of pressure chambers configured as longitudinally extending ribs which conveniently serve to centralize the casing within the wellbore.

2. Description of Related Art

Wellbores are typically drilled using a drilling string with a drill bit secured to the lower free end and then completed by positioning a casing string within the wellbore. The casing increases the integrity of the wellbore and provides a flow path between the surface and selected subterranean formations for the withdrawal or injection of fluids.

Casing strings normally comprise individual lengths of metal tubulars of large diameter. These tubulars are typically secured together by screw threads or welds. Conventionally, the casing string is cemented to the well face by circulating cement into the annulus defined between the outer surface of the casing string and the wellbore face. The casing string, once embedded in cement within the well, is then perforated to allow fluid communication between the inside and outside of the tubulars across intervals of interest. The perforations allow for the flow of treating chemicals (or substances) from the inside of the casing string into the surrounding formations in order to stimulate the production or injection of fluids. Later, the perforations are used to receive the flow of hydrocarbons from the formations so that they may be delivered through the casing string to the surface, or to allow the continued injection of fluids for reservoir management or disposal purposes.

Perforating has conventionally been performed by means of lowering a perforating gun on a carrier down inside the casing string. Once a desired depth is reached across the formation of interest and the gun secured, it is fired. The gun may have one or many charges thereon which are detonated using a firing control, which is activated from the surface via wireline or by hydraulic or mechanical means. Once activated, the charge is detonated to penetrate and thus perforate both the casing, cement, and to a short distance, the formation. This establishes the desired fluid communication between the inside of the casing and the formation. After firing, the gun is either raised and removed from the wellbore, left in place, or dropped to the bottom thereof.

Examples of the known perforating devices can be found in U.S. Pat. No. 4,538,680 to Brieger, et al.; U.S. Pat. No. 4,619,333 to George; U.S. Pat. No. 4,768,597 to Lavigne, et al.; U.S. Pat. No. 4,790,383 to Savage, et al.; U.S. Pat. No. 4,911,251 to George, et al.; U.S. Pat. No. 5,287,924 to Burleson, et al.; U.S. Pat. No. 5,423,382 to Barton, et al.; and U.S. Pat. No. 6,082,450 to Snider, et al. These patents all disclose perforating guns that are lowered within a casing string carrying explosive charges, which are detonated to perforate the casing outwardly as described above. This technique provided the advantage of leaving the inside of the casing relatively unobstructed since debris and ragged edges would be outwardly directed by the detonations of the charges.

U.S. Pat. No. 6,386,288 issued to Snider, et al., describes an attempt to perforate a tubular from the outside. The technique in Snider involves the use of a perforating gun separate from and exterior to the casing to be perforated as can be seen in FIGS. 1-3.

Referring to FIG. 1, the Snider perforating gun 20 may be seen positioned within wellbore 2 adjacent the exterior of casing 12. The perforating gun 20 is secured to casing 12 by metal bands (not shown), which are wrapped around both casing 12 and perforating gun 20. The perforating gun 20 is constructed of metal. An electric line 18 extends from a power source (not illustrated) at the surface 4 to ignite the perforating gun 20. Snider discloses that other suitable control systems for igniting the explosive charge(s) contained in perforating gun 20, such as hydraulic lines connected to a suitable source of pressurized hydraulic fluid (liquid or gas) or electromagnetic or acoustic signaling and corresponding receivers connected to the perforating gun assemblies for wave transmissions through the casing, soil and/or wellbore fluids, may also be used. Snider indicates that conventional means are used to secure the lines to the casing at desired intervals.

Referring to FIG. 2, the Snider perforating gun 20 has two explosive charges, 22 and 26, contained therein, which are aimed toward casing 12. Charges 22 and 26 are axially spaced apart within perforating gun 20 and which, although oriented at slightly different angles, are both aimed toward casing 12. As can best be seen in FIG. 3, upon transmission of electrical current via line 18, explosive charge 22 detonates and fires a shaped charge along path 24 creating perforations 11 and 14 in the wall of casing 12. Explosive charge 26 detonates and fires a shaped charge along path 28 creating perforations 15 and 16.

When the Snider gun is detonated, portions of the gun act in a manner similar to shrapnel to perforate the casing string. This has disadvantages. First, the resulting perforations 11, 14, 15, and 16 tend to be ragged. Especially perforations 14 and 16—the ones furthest away from the gun. This is because the perforations 14, 16 at these remote locations are created using not only the shaped charge itself, but also portions of the casing blasted from perforations 11 and 15, when the proximate perforations were created. As a result, perforations 14 and 16 will be much less precise than perforations 11 and 15.

A second disadvantage is that all of the charges in the Snider gun are fired from the same point of origin relative to the circumference of the casing. Because of this, the perforations created are significantly asymmetrical. As can be seen in FIG. 3, perforations 11 and 15 are very close together, whereas perforations 14 and 16 are far apart.

The asymmetrical nature and raggedness of the perforations will cause the well to have poor in-flow properties when the well is placed into production.

Additionally, the raggedness of casing perforations 11 and 15 may occur to the extent that the ruptured inner surface of the casing could damage or even prevent passage of downhole tools and instruments. The structural integrity of the casing string might even be compromised to a degree.

A third disadvantage inherent in the method disclosed in Snider relates to the size of the cement-filled annulus created between the outer surface of the casing 12 and the inner surface of the bore hole. See FIG. 2. This is because perforating gun 20 is unreasonably large, and thus, the profile of the wellbore and casing 12 are not concentric. Rather, the center axis of the casing 12 is offset a great deal from the center axis of the wellbore to create sufficient space that the perforating gun 20 and a flapper housing (not pictured) may be received therein. The flapper housing is disposed below the gun and is used to seal off lower zones after they have been perforated. The annular gap must be made even larger if multiple guns are to be employed at a given depth. Because this annular gap must be made larger with the Snider method, either the bore size must be made bigger, or the casing must be made smaller in diameter. Both of these solutions have disadvantages. Even a slight increase in bore size will result in significant additional drilling costs. Reducing the diameter of the casing 12, however, will diminish the conduits flow abilities. Therefore, because deploying the Snider gun requires extra space outside the casing, the user must either pay additional drilling costs or suffer the consequence of reduced conduction of processing fluids.

A fourth disadvantage is that the Snider gun assembly is constructed of metal. This is disadvantageous in that when the guns are fired, metal fragments from the perforating gun 20 will cause collateral damage thus impairing the flow performance of the perforation tunnel. This could be avoided if a less destructive material were used.

Frequently a well penetrates multiple zones of the same formation and/or a plurality of hydrocarbon bearing formations of interest. It is usually desirable to establish communication with each zone and/or formation of interest for injection and/or production of fluids. Conventionally, this has been accomplished in any one of several ways. One way is to use a single perforating gun that is conveyed by wireline or tubing into the wellbore and an explosive charge fired to perforate a zone and/or formation of interest. This procedure is then repeated for each zone to be treated and requires running a new perforating gun into the well for each zone and/or formation of interest.

One alternative is to have a single perforating gun carrying multiple explosive charges. This multiple explosive charge gun is conveyed on wireline or tubing into the well and, as the gun is positioned adjacent to each zone and/or formation of interest, selected explosive charges are fired to perforate the adjacent zone and/or formation. In another alternative embodiment, two or more perforating guns, each having at least one explosive charge, are mounted spaced apart on a single tubing, then conveyed into the well, and each gun is selectively fired when positioned opposite a zone and/or formation of interest. When the select firing method is used, and the zone and/or formation of interest are relatively thin, e.g., 15 feet or less, the perforating gun is positioned adjacent the zone of interest and only some of the shaped charges carried by the perforating gun are fired to perforate only this zone or formation. The gun is then repositioned, by means of the tubing, to another zone or formation and other shaped charges are fired to perforate this zone or formation. This procedure is repeated until all zones and/or formations are perforated, or all of the shaped explosive charges detonated, and the perforating gun is retrieved to the surface by means of the tubing.

However, the necessity of tripping in and out of the wellbore to perforate and stimulate each of multiple zones and/or formations is time consuming and expensive. In view of this, multiple zones and/or formations are often simultaneously stimulated, even though this may result in certain zones and/or formations being treated in a manner more suitable for an adjacent zone and/or formation.

Another disadvantage in conventional systems regards the deployment of sensitive transmission lines outside the casing. It is often desirable to deploy a cable, fiber or tube along the length of a wellbore for connection to, or to act directly as, a sensing device. Where such a device is deployed outside a casing and where that casing is subsequently perforated, there exists a substantial risk that the device will be damaged by being directly impinged upon by the jet created by an exploding charge because the cables are not fixed at a known location to prevent being hit by the charge. This risk is elevated if the perforating system is difficult to orient within the wellbore. Thus, there is a need in the prior art for a method of protecting these sensitive transmission lines during perforation.

Thus, a need exists for (i) a modular perforation assembly which is conveyed by the casing as it is lowered within the wellbore so that it eliminates the need to run perforating equipment in and out of the well when completing multiple zones and/or formations; (ii) that the assembly be externally-mounted in such a way that the casing will be centered rather than offset within the wellbore upon its installation; (iii) that the assembly create perforations which are equally spaced and precise so that the perforated casing will have desirable in-flow characteristics and not be obstructed; (iv) that the charges of the assembly are fired from a plurality of points of origin about the periphery of the casing, but are limited in power so that they will penetrate the casing only once and will cause no damage to the rest of the casing; (v) that the perforations created do not significantly compromise the structural integrity of the casing; (vi) that the charges are fired in opposite directions so that different charges may be fired to rupture the casing wall while other more powerful charges are used to perforate the formation; (vii) a frame for the assembly that is easily constructed and will protectively maintain the charges on the outside of the casing in a dry and pressure-controlled environment; (viii) that the portions of the frame through which the charges are blasted into the formation be constructed of a less-damaging material than metal in order to minimize collateral formation damage that might be caused by the charges, and (ix) that a method be provided that enables perforation to be accomplished without damaging sensitive casing-conveyed transmission lines.

SUMMARY OF THE INVENTION

The present invention therefore, provides an apparatus for perforating a subterranean-earth formation through a wellbore lined with casing comprising i) a cylinder longitudinally secured on said casing, said cylinder having an inside surface, an outside surface, and two ends; ii) an end cap secured at each end of said cylinder fluidly isolating a chamber from all wellbore fluids, said chamber defined by said inside surface of said cylinder and said end caps; and iii) an explosive charge being disposed in said chamber.

The present invention further provides a gun assembly for perforating a subterranean-earth formation through a wellbore lined with casing wherein said casing has inside and outside surfaces, comprising i) a first charge directed outward towards the formation to perforate the formation; and ii) a second charge directed inward towards the casing to perforate the casing.

The present invention further provides an apparatus for perforating a casing string comprising i) a first module and a second module, each first and second module comprising a gun assembly contained therein, the first module being positioned longitudinally adjacent the second module on the casing string; ii) a firing assembly for igniting the gun assembly in the first module; iii) a remote signaler to remotely detonate the firing assembly; and iv) a ballistic transfer assembly for igniting the gun assembly in the second module.

The present invention further provides an apparatus for perforating a subterranean-earth formation through the wellbore lined with casing comprising a plurality of chambers, each chamber containing a gun assembly therein, each gun assembly containing at least one explosive charge, said plurality of chambers disposed about the periphery of said casing such that said casing is substantially centered when introduced into and maintained in said wellbore.

The present invention further provides a method for perforating a subterranean-earth formation through a wellbore lined with casing, comprising the steps of i) attaching a plurality of explosive charges to an outside surface of said casing as said casing is run in the wellbore; ii) directing at least one of said plurality of explosive charges to perforate said casing and at least one of said plurality of explosive charges to perforate said formation; iii) positioning said plurality of explosive charges on said casing substantially adjacent a preferred zone within said formation to be perforated; and iv) detonating said plurality of explosive charges.

The present invention further provides a method for perforating a subterranean-earth formation through a wellbore lined with casing, comprising the steps of i) providing a plurality of gun assemblies; ii) disposing each of said gun assemblies in separate sealed chambers; iii) attaching each of said chambers on the exterior of the casing to form a number of longitudinal fins; and iv) using the longitudinal fins to center the casing within the wellbore when the casing is run down into the wellbore.

The present invention further provides an apparatus for perforating a subterranean-earth formation through a wellbore lined with casing, comprising i) a first module comprising a first gun assembly mounted on said casing at a first depth in the wellbore proximate a first zone of interest in said formation; and ii) a second module coupled with said first module, said second module comprising a second gun assembly mounted on said casing at a second depth in the wellbore proximate a second zone of interest in said formation.

The present invention further provides an apparatus for perforating a subterranean-earth formation through a wellbore lined with casing, comprising the steps of i) securing a first module comprising a first gun assembly at a first position on said casing; ii) securing a second module comprising a second gun assembly at a second position on said casing; iii) selecting said first position and said second position so that when said casing is positioned in said wellbore, said first module is proximate a first zone of interest in said formation and said second module is proximate a second zone of interest in said formation; iv) placing said casing in said wellbore; v) detonating said first gun assembly; and vi) detonating said second gun assembly by a ballistic transfer of energy from said first gun assembly.

The present invention further provides a firing assembly for activating a perforating device and perforating a subterranean-earth formation through a wellbore lined with casing, said perforating device comprising a module having a first chamber and a second chamber, said first chamber including a first gun assembly and said second chamber including a second gun assembly, said firing assembly comprising: i) a firing head for transferring ballistic energy to the perforating device, said firing head having a detonator and a plurality of ballistic charges, said detonator coupled to at least one of said first gun assembly and said second gun assembly; ii) a remote signaler for sending a detonation signal; and iii) a receiving device for receiving said detonation signal and activating said detonator, said detonator causing at least one of said plurality of ballistic charges to explode and detonate at least one of the first gun assembly and the second gun assembly.

The present invention further provides a carrier for a perforating device, the perforating device causing the perforation of a subterranean-earth formation through a wellbore, the carrier comprising i) a clamp for securing the perforating device; and ii) a plurality of fasteners for securing the carrier to an object within the wellbore.

The present invention further provides an apparatus for perforating a subterranean-earth formation through a wellbore, the apparatus comprising a carrier and a perforating device, the carrier comprising a plurality of fasteners for securing the carrier to an object within the wellbore.

The present invention further provides an apparatus for perforating a subterranean-earth formation through a wellbore lined with casing, the apparatus comprising a gun assembly secured to an exterior surface of the casing, the gun assembly comprising a first charge and a second charge, the first charge being positioned to form a first opening in the formation for fluid communication between the wellbore and the formation, the second charge being positioned to form a second opening for fluid communication between the wellbore and an area inside the casing, the first opening defining a first flow path and the second opening defining a second flow path, the first flow path being substantially non-perpendicular to a plane that is substantially perpendicular to the second flow path.

The present invention further provides an apparatus for carrying a perforating device capable of perforating a subterranean-earth formation through a wellbore, the apparatus comprising a carrier, the carrier comprising a bracket for securing the perforating device and a plurality of fasteners for securing the carrier to an object within the wellbore, at least one fastener being releasably secured to the bracket for adjusting the carrier on the object.

The present invention further provides an apparatus for perforating a subterranean-earth formation through a wellbore lined with perforated casing, the apparatus comprising a gun assembly secured to an exterior surface of the casing, the gun assembly comprising a charge positioned to form an opening in the formation for fluid communication between the formation and an area inside the casing, the opening defining a flow path substantially non-perpendicular to a plane that is substantially perpendicular to a flow path defined by an opening in the casing.

The present invention further provides an apparatus for transferring ballistic energy from one perforating device to another perforating device over a casing joint, the apparatus comprising: i) a first bracket secured to a casing segment; ii) a second bracket secured to another casing segment; and iii) a chamber secured between the first bracket and the second bracket, the chamber comprising a first ballistic charge, a second ballistic charge, and a medium for transferring the ballistic energy from the first ballistic charge to the second ballistic charge.

The present invention further provides a firing head for activating a perforating device capable of perforating a subterranean-earth formation through a wellbore, the perforating device comprising a plurality of gun assemblies, each gun assembly comprising a plurality of explosive charges, the firing head comprising: i) a body comprising a plurality of longitudinal passages therethrough, at least one passage for receipt of a tubular object; ii) a plurality of donor charges, each donor charge secured within a respective longitudinal passage and positioned near a respective gun assembly; and iii) a firing assembly for detonating the plurality of donor charges, the detonation of each donor charge creating ballistic energy that is transferred to a respective gun assembly for detonating the plurality of explosive charges contained therein.

The present invention further provides an apparatus for transferring ballistic energy from a perforating device to another perforating device, the perforating device and the another perforating device each comprising a gun assembly, each gun assembly comprising a plurality of explosive charges, the apparatus comprising: i) a body comprising a plurality of longitudinal passages therethrough, at least one passage for receipt of a tubular object; ii) a donor charge secured within one of the plurality of longitudinal passages, the donor charge being positioned near the gun assembly of the perforating device; iii) another donor charge secured within at least one of the one of the plurality of longitudinal passages and another one of the plurality of longitudinal passages, the another donor charge being positioned near the gun assembly of the another perforating device; and iv) a detonating medium for transferring the ballistic energy from the donor charge to the another donor charge.

The present further provides an apparatus for carrying a perforating device capable of perforating a subterranean-earth formation through a wellbore, the apparatus comprising: i) a tubular member, the tubular member comprising an exterior surface; and ii) a bracket secured to the exterior surface of the tubular member for securing the perforating device.

BRIEF DESCRIPTION OF DRAWINGS

The invention will be described with reference to the accompanying drawings, in which like elements are referenced with like reference numerals, and in which.

DETAILED DESCRIPTION OF THE INVENTION

The present invention generally provides various apparatus and methods for externally perforating a wellbore casing and formation. The present invention relates to a casing conveyed perforating system attached to the outside of the casing and is conveyed along with the casing when it is inserted into the wellbore.

Figure 1:
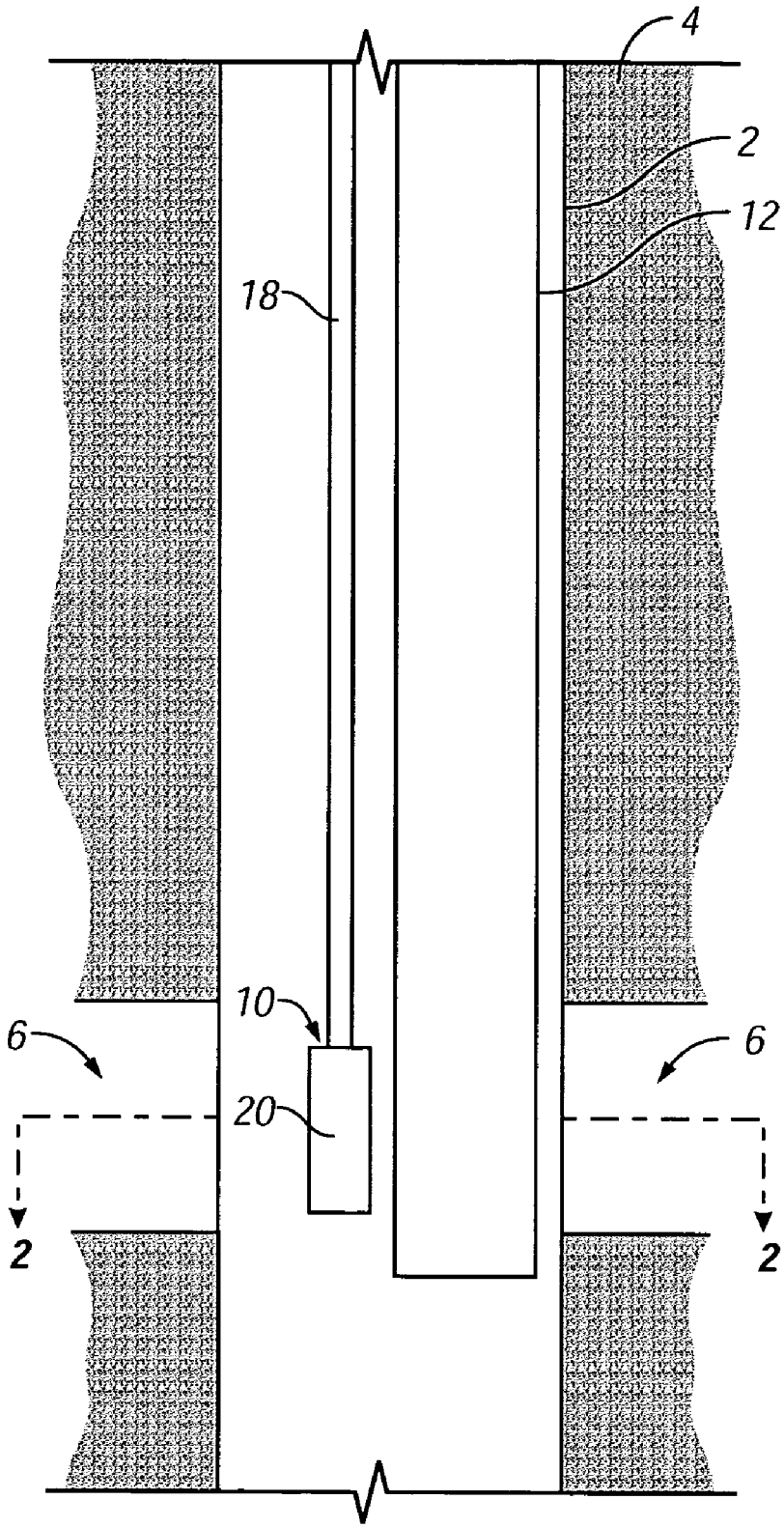
FIG. 1 (Prior Art)
FIG. 1 is a partial cross-sectional view of the Snider perforating gun assembly positioned in a subterranean wellbore.
Figure 3:
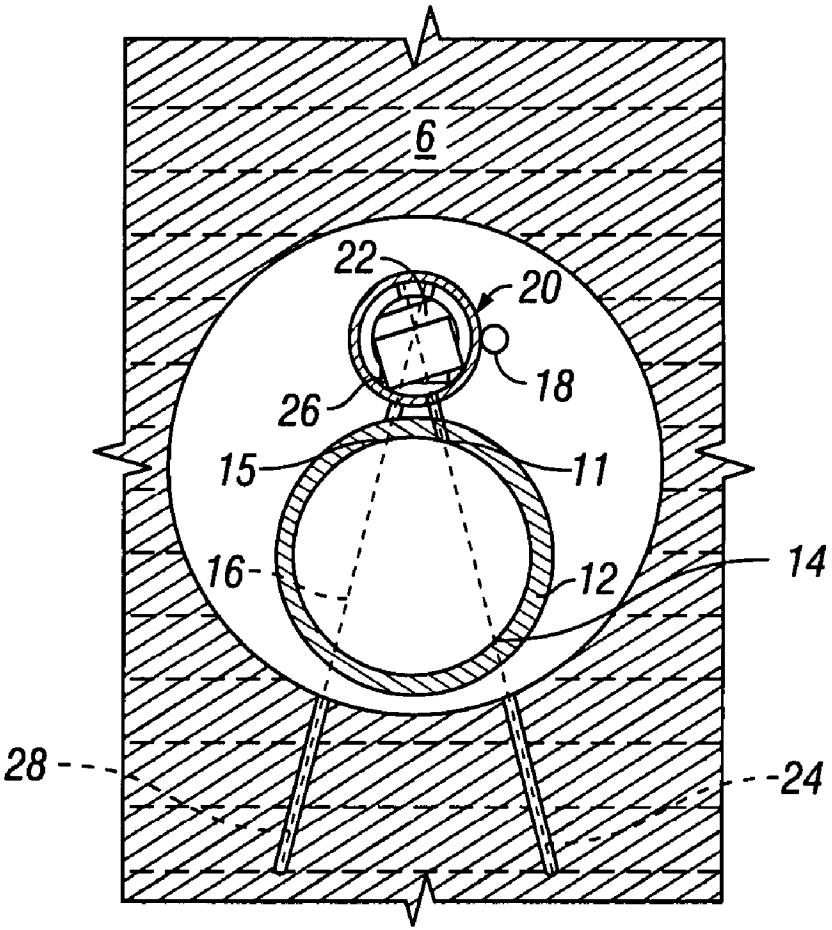
FIG. 3 (Prior Art)
FIG. 3 is a cross-sectional view of FIG. 1 along line 2-2 after the explosive charges are detonated.
Figure 2:
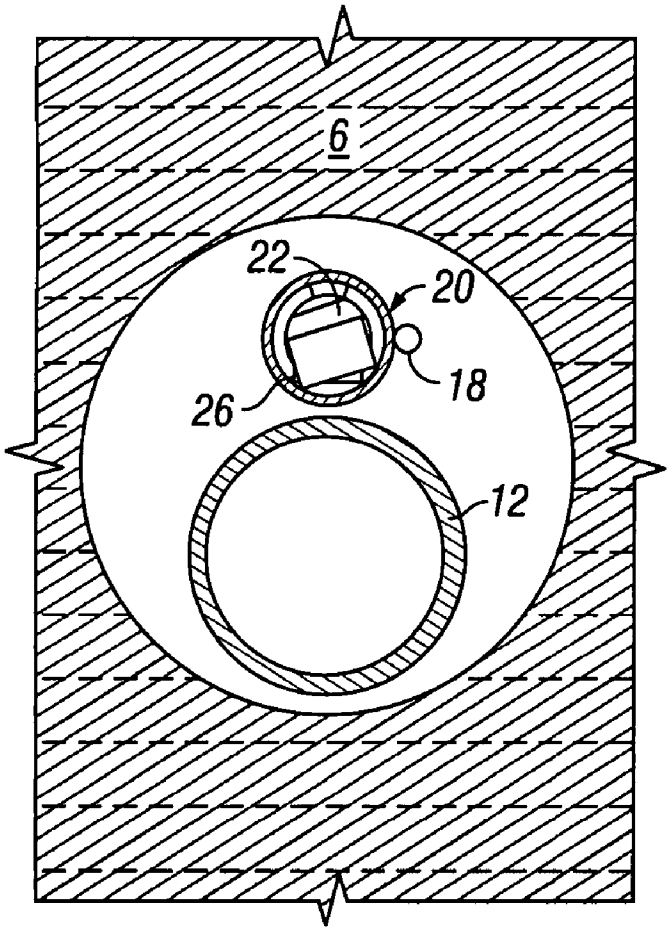
FIG. 2 (Prior Art)
FIG. 2 is a partial cross-sectional view of FIG. 1 along line 2-2 before the explosive charges are detonated.
Figure 4:
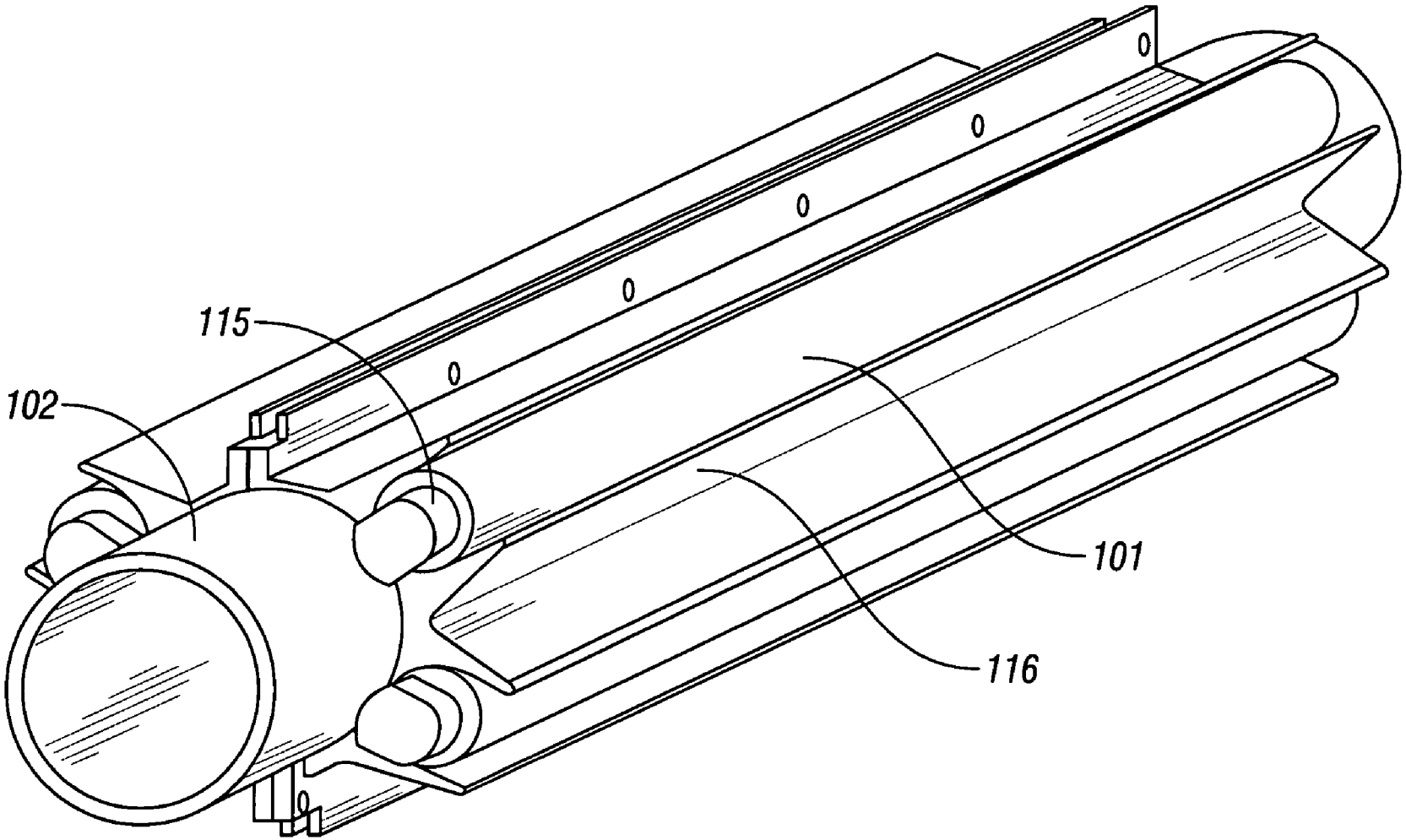
FIG. 4 is a perspective view of one embodiment of the present invention illustrating a carrier with multiple pressure chambers attached to a segment of casing.

Referring first to FIG. 4, the present invention comprises a plurality of pressure chambers 101, which are arranged radially around the outside of a wellbore casing 102. Each pressure chamber 101 is used to protect the relatively sensitive components contained therein.

The casing 102, which may comprise a number of casing segments, is run into the wellbore after it has been drilled in a manner known to those skilled in the art. Cement is then typically poured around the casing to fill in an annular space or gap between the casing 102 and the wellbore. Hydrostatic pressure created by any fluid in the wellbore, e.g., mud, brine, or wet cement, creates pressures that might damage gun components such as detonating equipment or charges. The pressure chamber 101 guards against such damage.

It is not necessary, however, that the present invention be used only in cemented completions. The present invention may also be used in applications where cement is not placed around the casing 102.

Regardless of the application, each pressure chamber 101 is a tubular vessel of constant internal diameter. The pressure chamber 101 is capable of withstanding external wellbore pressure while maintaining atmospheric pressure therein. Each pressure chamber 101 may be constructed of a material resistant to abrasion and impermeable to wellbore fluids. It may also be resistant to chemical degradation under prolonged exposure to wellbore fluids at bottom hole temperature and pressure. Each pressure chamber 101 may be either metallic or non-metallic in nature and sealed at both ends by end caps 115. Each pressure chamber 101 may be secured to maintain the orientation of its contents relative to a surface of the casing 102. It may also have an internal diameter not less than that required to accommodate one or more shaped charges 104 shown in FIG. 5.

Figure 9A:
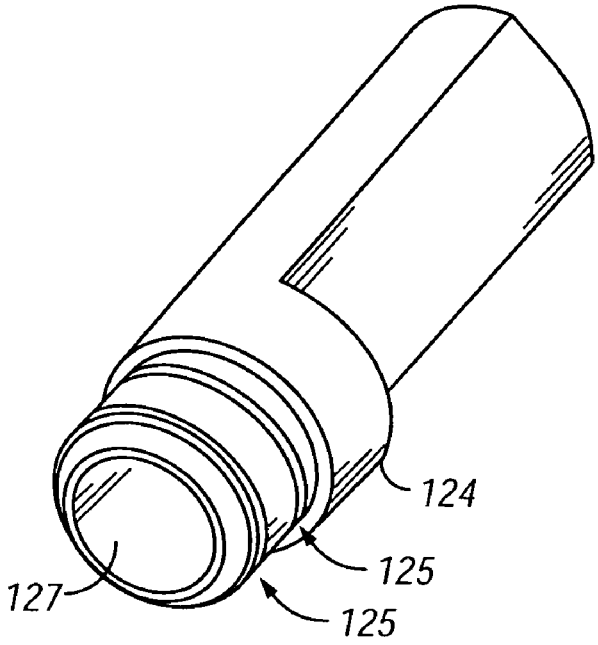
FIGS. 9A-D illustrate various views of an end cap of the present invention.
Figure 9B:
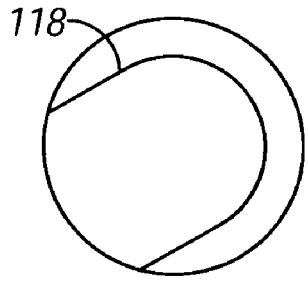
Figure 9C:
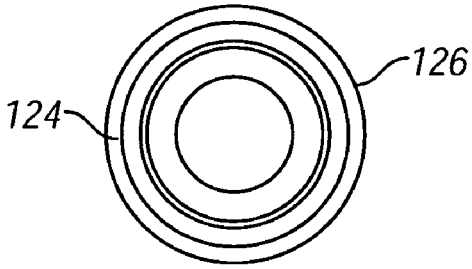
Figure 9D:
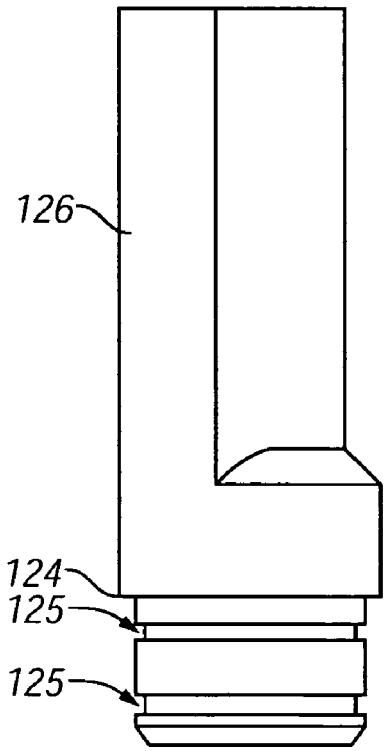

One embodiment of a pressure chamber 101 comprises a tube having a circular cross-section. The pressure chamber 101 may be manufactured with a composite material such as carbon fiber winding saturated with a thermoplastic resin. The pressure chamber 101 is held in position relative to the casing 102 by a carrier 116 and is secured in position by a clamp 117, which is illustrated in FIG. 12B. The pressure chamber 101 is made stationary as a result of a square profile 118 (FIG. 9B) on its end cap 115, and a matching profile 132 (FIG. 12B) on clamp 117. Alternatively, the pressure chamber 101 may be held in place by other conventional means such as set screws (not shown) that pass through the clamp 117 into grooves (not shown) on each end cap 115.

Each end cap 115 forms a plug to seal the end of the respective pressure chamber 101 as illustrated in FIGS. 9A-D. Each end cap 115 has a profile 124 (FIG. 9C) that allows its insertion to a fixed distance into the pressure chamber 101. Sealing elements 125, which may comprise O-rings, provide pressure isolation between the inside of the pressure chamber 101 and the wellbore environment. Another profile 126 may also be provided to prevent rotation of the pressure chamber 101 relative to the casing 102. Each end cap 115 also has an internal bore 127 along its axis. Bore 127 does not extend entirely through the end cap 115, which enables ballistic transfer devices, referred to herein as a receiver charge 120 or a booster charge 121, to be fixed within the end cap 115. Each end cap 115 may be metallic or non-metallic in nature. Preferably, each end cap 115 may be constructed of composite materials. Composite articles, such as the pressure chamber 101 and end cap 115, may be supplied by Airborne Products, BV located in Leidschendam, Netherlands.

Figure 5:
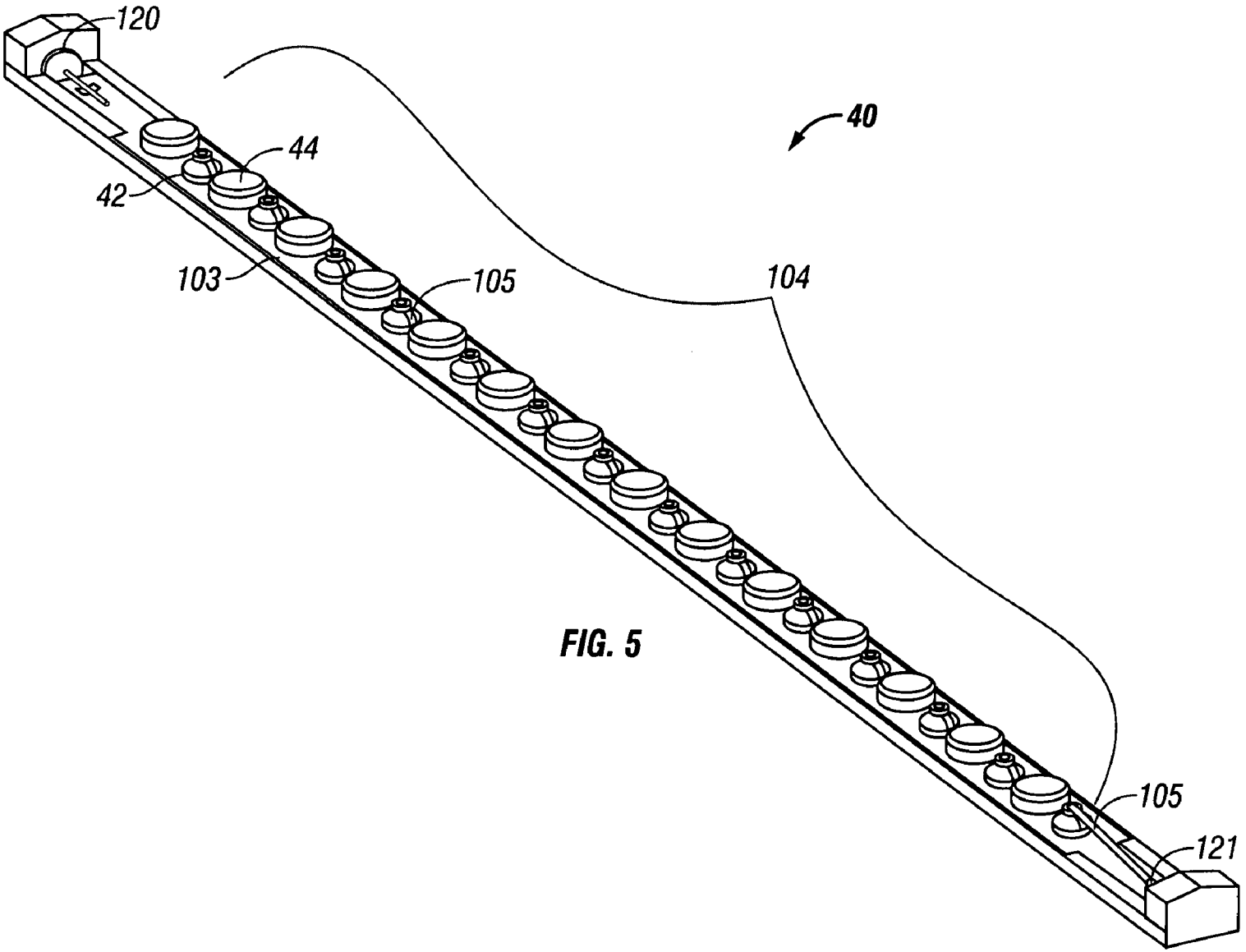
FIG. 5 is a perspective view of the present invention illustrating a perforating gun assembly.
Figure 8:
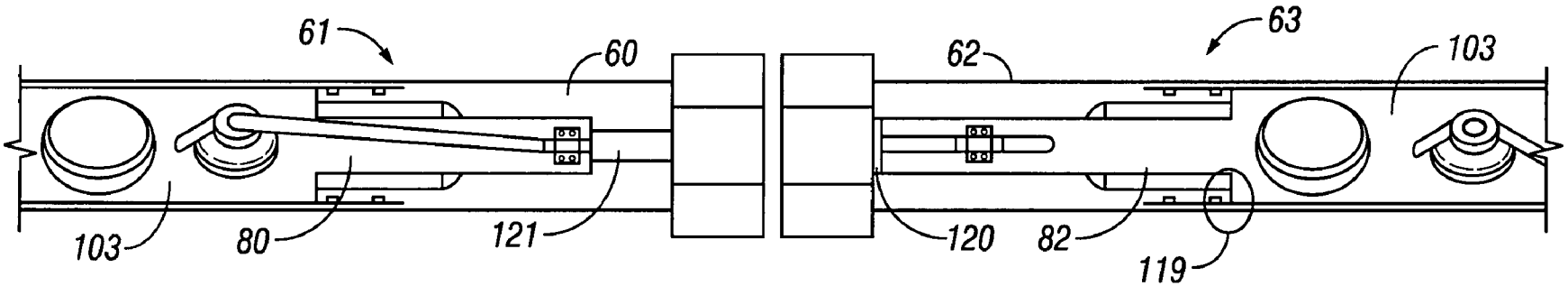
FIG. 8 is a partial side view of the present invention illustrating two perforating gun assemblies positioned end to end.

Inside each pressure chamber 101 is gun assembly 40 as shown in FIG. 5. The gun assembly 40 comprises a flat metal strip 103, which is typically used within hollow carrier perforating devices in the oilfield. As shown in FIG. 8, minimized portions 80, 82 of each strip 103 are received in each end cap 115. Slots 119 in each end cap 115 hold the strip 103 so that it does not rotate within the pressure chamber 101. Thus, strip 103 is secured within pressure chamber 101. Holes are machined into strip 103 so that it can accommodate the shaped charges 104. Slots are machined into strip 103 in order to accommodate the detonating cord 105, which is used to provide ballistic transfer between the shaped charges 104 and between the ballistic transfer devices 120 or 121 contained in each end cap 115.

The shaped charges 104 may be separated into two groups. A first group 42 may be positioned to face the casing 102, and a second group 44 may be positioned to face the formation. The charges in the two groups 42 and 44 may be alternatively spaced. It is known that different types of charges are better for blasting into metal surfaces (such as casings) than other types of charges that are better for blasting into rock formations. Contrary to conventional perforation techniques that require the shaped charges to penetrate both the metallic casing and rock formations, the gun assembly 40 allows the use of different types of charges depending on the perforation requirements.

Charges such as those used here are typically metallic in nature, containing pressed explosives and a pressed metal or forged liner, creating a shaped explosive charge, as is typically used in oilfield perforating devices. When ignited, they will create a hole of specific dimensions through the material into which they are fired. These charges must be maintained in an environment of low humidity and at atmospheric pressure. This is accomplished by the pressure chamber 101, which protects the charges from subterranean fluids and the tremendous pressures encountered within the wellbore. The charges of the first group 42 will perforate through the pressure chamber 101, the carrier 116, and an adjacent wall of the casing 102. These shaped charges will not, however, damage in any way the wall of the casing 102 diametrically opposite from the point of perforation. The charges of the second group 44 will perforate through the pressure chamber 101 and through any surrounding cement barrier into the adjacent rock formation. This may be perpendicular or tangential to the surface of the casing 102, or form any other angle thereto.

Figure 13:
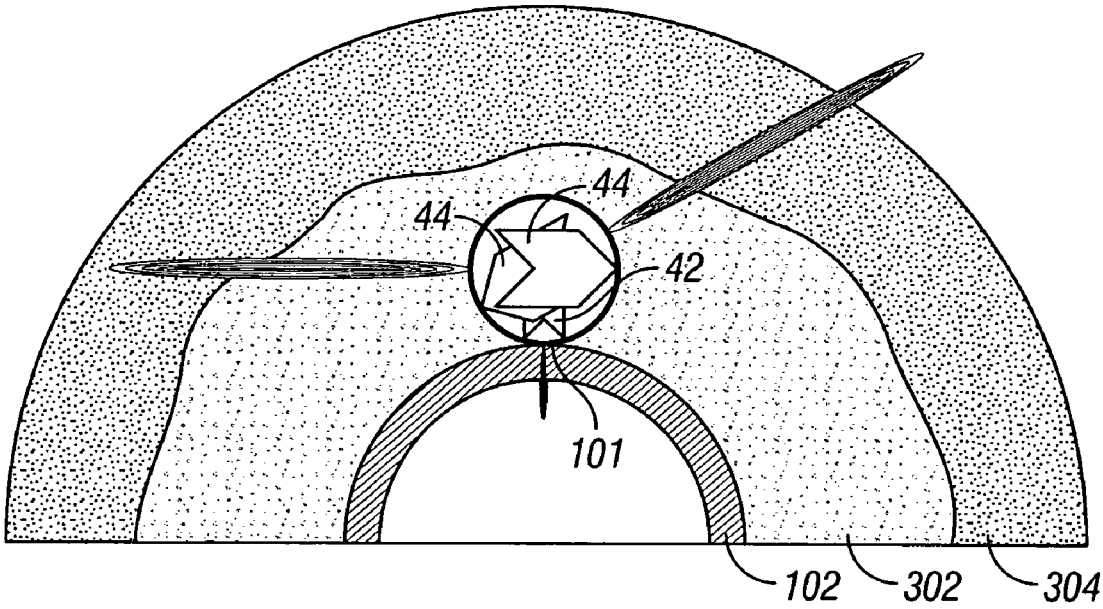
FIG. 13 is a partial cross-sectional view of another embodiment of the perforating gun assembly illustrating the detonation effects of another arrangement of the shaped charges in FIG. 5.

For example, in FIG. 13, the first group 42 of shaped charges is positioned in the pressure chamber 101 facing the casing 102. These smaller shaped charges contain enough explosive to perforate the casing 102 where it meets the pressure chamber 101 without perforating any other area of the casing 102. The first group 42 of smaller charges are therefore, preferably positioned perpendicular to the casing 102 to maximize the perforated opening therein. The second group 44 of larger shaped charges may be positioned tangentially to an exterior surface to the casing 102 and facing generally a cement barrier 302 and the formation 304. These larger shaped charges contain enough explosive to perforate through the pressure chamber 101, the cement barrier 302 and substantially into the formation 304 as illustrated in FIG. 13. The benefits of providing an apparatus that is capable of carrying various-shaped charges that can be positioned at various angles relative to the casing 102, include improved production flow, flexibility and reduced casing strain. Production flow is improved because the production flow path does not directly impinge on the casing 102 at a point where the casing is perforated, which can cause plugging of the perforated opening(s) in the casing 102. Moreover, the capability of phasing the first group 42 and second group 44 of shaped charges provides flexibility in the selection and placement of these shaped charges dependent upon the formation characteristics, reservoir type and casing type. For example, if perforated or slotted casing is used, the first group 42 of smaller-shaped charges is unnecessary. The option to utilize a smaller-shaped charge to perforate the casing 102, or no charge at all, relieves the conventional strain imposed on the casing 102 when there are multiple perforations circumscribing the casing in a confined area. Finally, flexibility in the selection and arrangement of various-shaped charges also improves production flow characteristics by perforating in more near wellbore directions than conventional perforating methods.

Figure 14A:
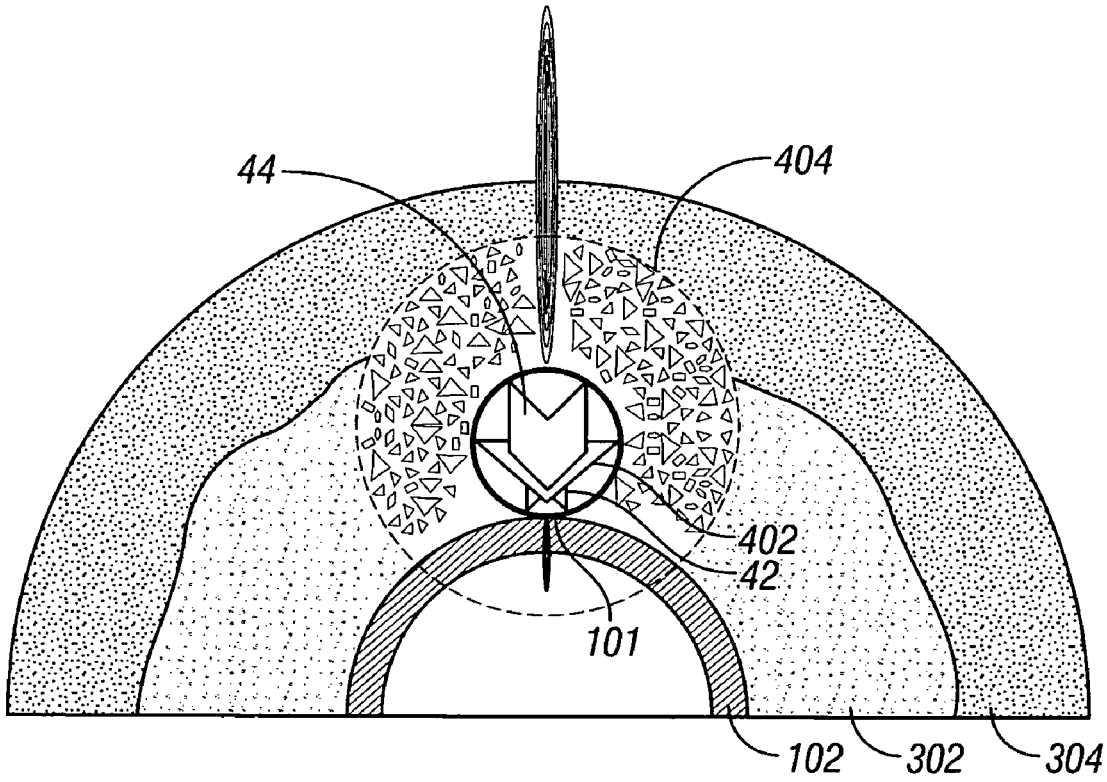
FIG. 14A is a partial cross-sectional view of another embodiment of the perforating gun assembly illustrating the detonation effects of one arrangement of the shaped charges in FIG. 5 and linear charges.
Figure 14B:
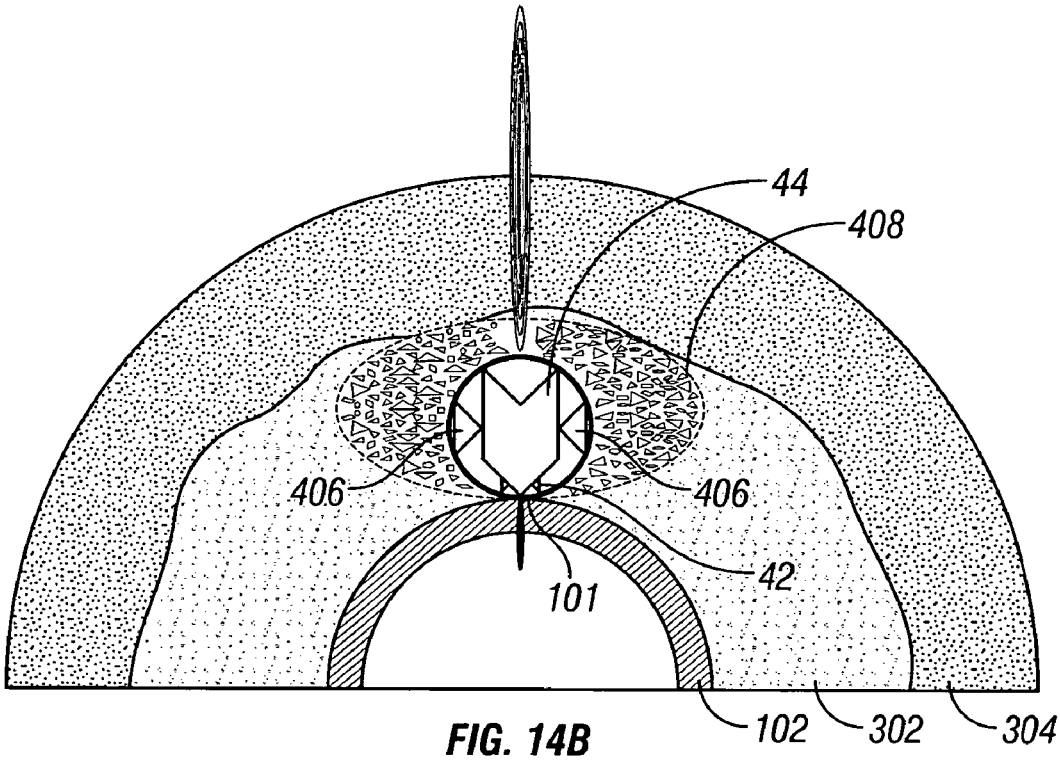
FIG. 14B is a partial cross-sectional view of another embodiment of the perforating gun assembly illustrating the detonation effects of another arrangement of the shaped charges in FIG. 5 and linear charges.
Figure 14C:
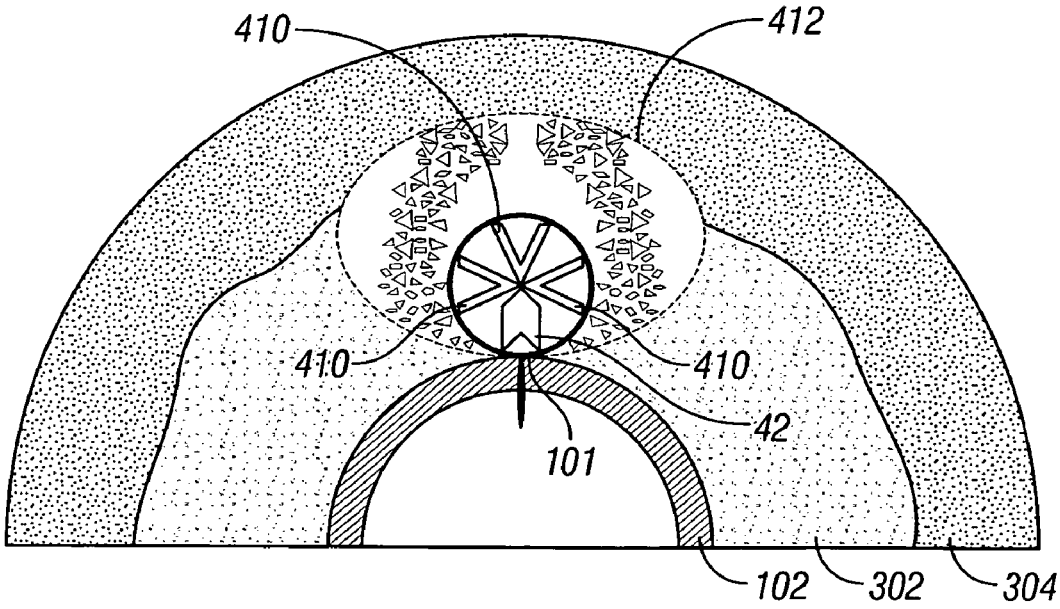
FIG. 14C is a partial cross-sectional view of another embodiment of the perforating gun assembly illustrating the detonation effects of yet another arrangement of shaped charges in FIG. 5 and linear charges.

In FIGS. 14A-C, various other embodiments of the perforating gun assembly illustrate the detonation effects of shaped and linear charges. Referring to the embodiment in FIG. 14A, the first group 42 of smaller-shaped charges is positioned facing the casing 102 in the pressure chamber 101. The second group 44 of larger-shaped charges is positioned in the pressure chamber 101 facing the formation 304. The first group 42 of smaller-shaped charges is positioned in the pressure chamber 101, and contains a sufficient amount of explosive to perforate the casing 102 that meets the pressure chamber 101 without perforating any other area of the casing 102. As a result, the first group 42 of smaller-shaped charges forms an opening in the casing 102 that is large enough to provide fluid communication between the formation 304 and an area within the casing 102. The second group 44 of larger-shaped charges contains enough explosive to pierce the pressure chamber 101 and form an opening in the cement barrier 302 and formation 304 for fluid communication between the formation 304 and the area inside the casing 102. A third group 402 of linear charges may be positioned in the pressure chamber 101 facing the formation 304, which provides a greater force of impact near the pressure chamber 101 for pulverizing the cement barrier 302 and formation 304 in the target zone 404.

The benefits of providing a third group 402 of linear charges include improved production flow. For example, linear charges facing the formation enable deeper penetration into the formation 304 while pulverizing the target zone 404. The result provides more space in the target zone 404 for fluid communication between the formation 304 and the area inside the casing 102. Thus, the use of linear charges may preclude the need for many post-perforation stimulation processes. Additionally, the use of linear charges provides additional flexibility in the selection and arrangement of the charges depending on formation characteristics, reservoir type and casing strength. For example, use of linear charges may be preferred when the anticipated target zone is substantially longitudinal and aligned with the casing. In applications where the casing is longitudinally perforated, the preference of linear charges over other shaped charges is underscored.

Referring now to the embodiment in FIG. 14B, the first group 42 of smaller-shaped charges and second group 44 of larger-shaped charges are positioned in the same manner as those described in reference to FIG. 14A. A third group 406 of linear charges, however, may be positioned on opposite sides of the second group 44 of shaped charges generally facing the formation 304. The linear charges create a more elliptical target zone 408 that is substantially restricted to the cement barrier 302. This embodiment therefore, illustrates another possible arrangement of the charges depending on formation characteristics, reservoir type and casing strength.

Referring now to the embodiment in FIG. 14C, a third group 410 of linear charges may be positioned at various locations in the pressure chamber 101 generally facing the formation 304. The linear charges may be substituted in place of the second group 44 of larger-shaped charges and illustrate yet another possible arrangement and selection of the charges.

The perforating gun assembly embodiments described in reference to FIGS. 13 and 14A-C can deliver up to 32 shots per foot facing the formation and 24 shots per foot in multiple planes facing the casing. Thus, the larger-shaped charges facing the formation may be phased (positioned) in the system at 32 different planes around the circumference of the casing facing the formation over a one-foot section corresponding to 32 shots per foot, each shot corresponding with a different larger-shaped charge. The embodiments thus described may incorporate either composite-shaped charges or steel-shaped charges, depending upon the construction of the pressure chamber 101, the density of the cement barrier 302 and the characteristics of the formation 304.

Figure 10:
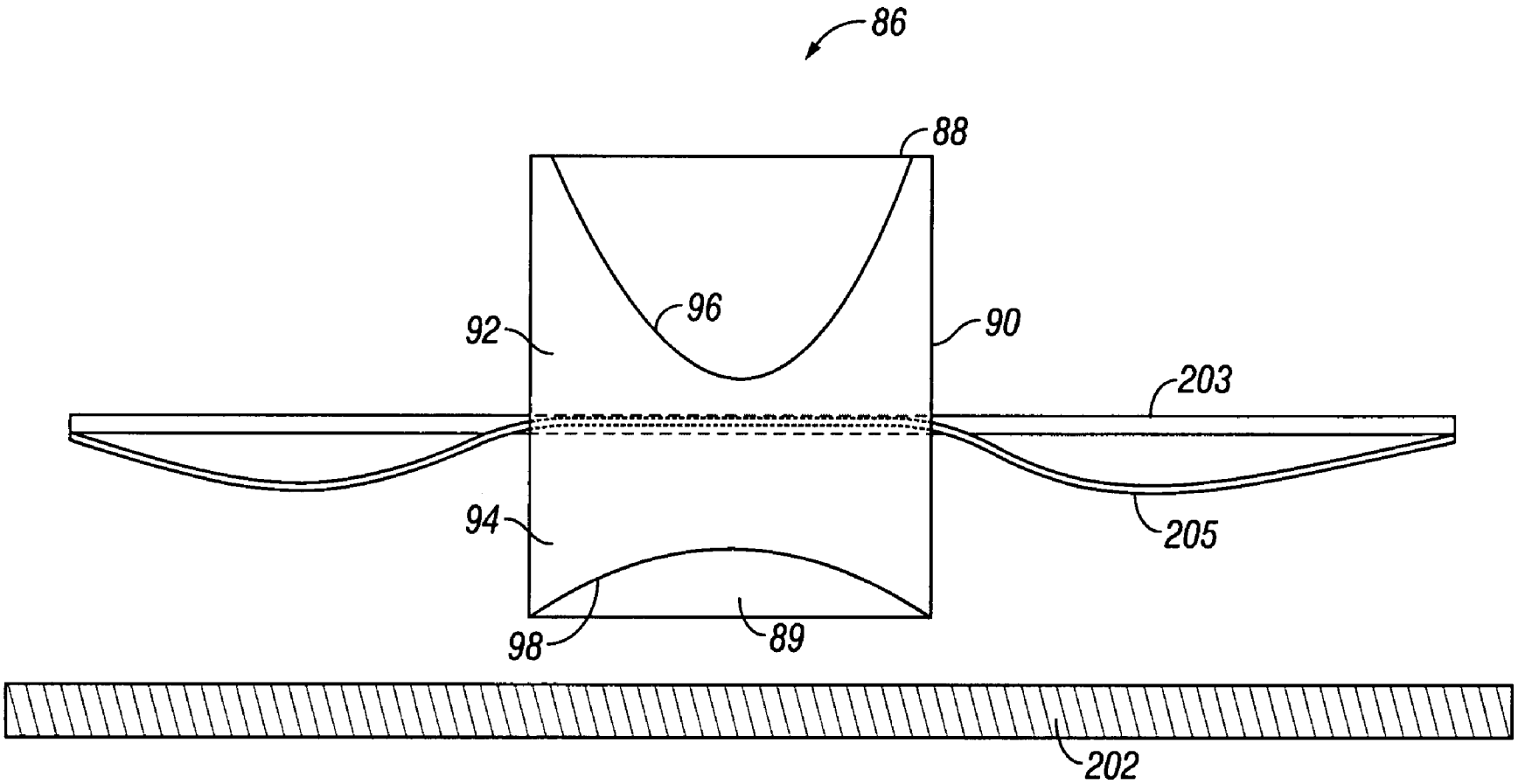
FIG. 10 is a side view of the present invention illustrating a bi-directional charge.

In the embodiment illustrated in FIG. 10, all of the shaped charges are bi-directional in nature, having both inward and outward-firing components so as to fire two separate shaped charges in opposite directions—simultaneously. For example, a bi-directional charge 86 is contained in a charge capsule 90. A first charge component 88 is aimed in the direction of the formation. A second charge component 89 is aimed at the casing 202. Both first and second charge components 88, 89 comprise pressed explosives that are contained within shaped liners 92 and 94, respectively. Liners 92 and 94 have liner profiles 96 and 98, respectively, that direct the explosive perforating jets emitted after detonation. The first charge component 88 is much larger than the second charge component 89 in order to maximize penetration into the formation using a larger charge component, while providing the minimum required explosive mass to satisfactorily penetrate the casing 202. Because much less penetrating force is necessary to pierce the casing 202, the second charge component 89 is much smaller. This limitation in the explosive force created also prevents damage of any kind to the wall of the casing 202 diametrically opposite from the point of perforation. The bi-directional charge 86 is arranged on a metal strip 203 in the same manner as the shaped charges 104 shown in FIG. 5. The bi-directional charge 86 is also connected to a detonating cord 205 in much the same way—except that the detonating cord 205 bisects liners 92 and 94. Bi-directional charges may be arranged in any pattern within the pressure chamber 101 and are maintained in an environment of low humidity and at atmospheric pressure by means of the pressure chamber 101. Like the embodiment shown in FIG. 5, the charges are maintained in ballistic connection by means of the detonating cord 205.

In either embodiment, the detonating cord 105 or 205 is used to ignite all of the charges used to perforate the casing and formation. The detonating cord 105 or 205 may be Primacord® or any other well-known explosive detonating cord that is typically used in oilfield perforating operations (and other applications such as mining), and may comprise an RDX or HMX explosive within a protective coating. The type of cord chosen should also have the capability to provide ballistic transfer between an electronic detonator and a ballistic transfer device, between ballistic transfer devices, and between ballistic transfer devices and shaped charges. The detonating cord referred to in various other embodiments hereinafter described may be Primacord® or any other well-known explosive detonating cord that is typically used in oilfield perforating operations and other applications such as mining.

Figure 21A:
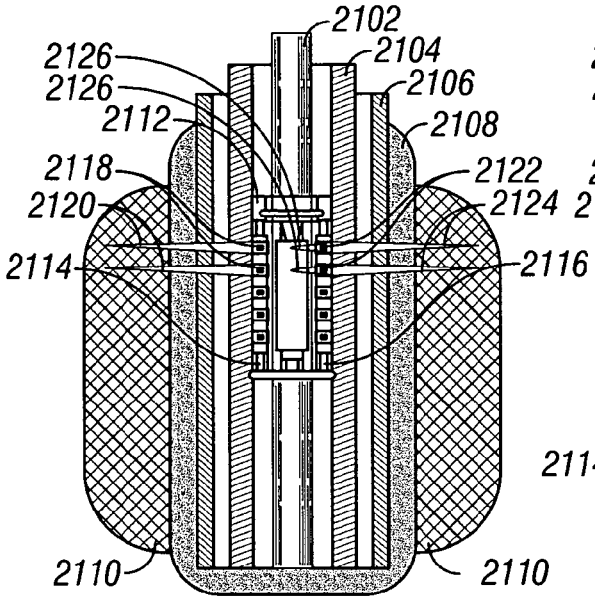
FIG. 21A is a partial cross-sectional view illustrating the application of bi-directional charges to a production-tubing configuration.

Referring now to FIGS. 21A-D, various applications of bi-directional charges are illustrated. In FIG. 21A, production tubing 2102 is positioned within a first casing string 2104, which is positioned within a second casing string 2106. The production tubing 2102, first casing string 2104 and second casing string 2106 may be secured within the wellbore by a cement barrier 2108. A carrier 2112 is preferably positioned on the production tubing 2102 at a depth adjacent an anticipated production zone in the formation 2110. The carrier 2112 includes a first pressure chamber 2114 and a second pressure chamber 2116. The first pressure chamber 2114 and the second pressure chamber 2116 each contain a plurality of charges. The shaped charges 2118 in the first pressure chamber 2114 contain enough explosive to form perforations 2120 through the first casing string 2104, the second casing string 2106, the cement barrier 2108 and into the formation 2110. In this manner, the shaped charges 2118 may be positioned to create a production flow path from the formation 2110 to an area inside the first casing string 2104. The bi-directional charges 2122 in the second pressure chamber 2116 contain enough explosive to form perforations 2124 through the first casing string 2104, the second casing string 2106, the cement barrier 2108 and into the formation 2110. The bi-directional charges 2122 also contain enough explosive to form perforations 2126 through the production tubing 2102. In this manner, the bi-directional charges 2122 may be positioned to create a production flow path from the formation 2110 to an area inside the production tubing 2102. The production flow paths created by perforations 2120 and perforations 2124 maintain fluid communication with the area inside the production tubing 2102 through the perforations 2126 in the production tubing 2102.

Figure 21B:
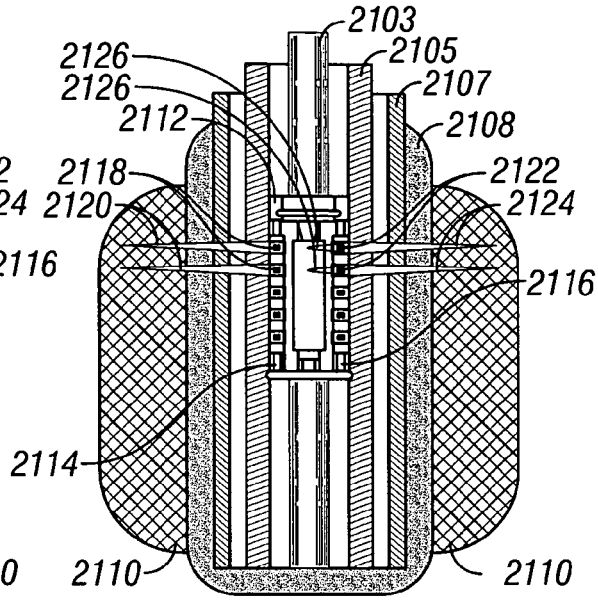
FIG. 21B is a partial cross-sectional view illustrating the application of bi-directional charges to a production-casing configuration.

In FIG. 21B, the carrier 2112 is positioned on production casing 2103 at a depth adjacent and anticipated production zone in the formation 2110. The production casing 2103 is positioned within an intermediate casing string 2105, which is positioned within a surface casing string 2107. The production casing string 2103, intermediate casing string 2105 and surface casing string 2107 may be secured within the wellbore by a cement barrier 2108. The shaped charges 2118 in the first pressure chamber 2114 contain enough explosive to form perforations 2120 through the intermediate casing string 2105, the surface casing string 2107, the cement barrier 2108 and into the formation 2110. In this manner, the shaped charges 2118 may be positioned to create a production flow path from the formation 2110 to an area inside the intermediate casing string 2105. The bi-directional charges 2122 in the second pressure chamber 2116 contain enough explosive to form perforations 2124 through the intermediate casing string 2105, the surface casing string 2107, the cement barrier 2108 and into the formation 2110. The bi-directional charges 2122 also contain enough explosive to form perforations 2126 through the production casing string 2103. In this manner, the bi-directional charges 2122 may be positioned to create a production flow path from the formation 2110 to an area inside the production casing string 2103. The production flow path created by perforations 2120 and perforations 2124 maintain fluid communication with the area inside the production casing string 2103 through the perforations 2126 in the production casing string 2103.

Figure 21C:
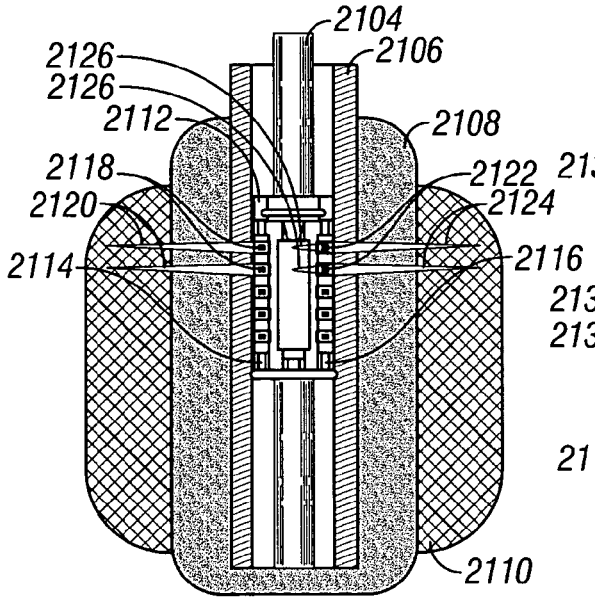
FIG. 21C is a partial cross-sectional view illustrating the application of bi-directional charges to a casing configuration.

In FIG. 21C, the carrier 2112 is positioned on the first casing string 2104 at a depth adjacent and anticipated production zone in the formation 2110. The first casing string 2104 is positioned within the second casing string 2106. The first casing string 2104 and the second casing string 2106 may be secured within the wellbore by a cement barrier 2108. The shaped charges 2118 in the first pressure chamber 2114 contain enough explosive to form perforations 2120 through the second casing string 2106, the cement barrier 2108 and into the formation 2110. In this manner, the shaped charges 2118 may be positioned to create a production flow path from the formation 2110 to an area inside the second casing string 2106. The bi-directional charges 2122 in the second pressure chamber 2116 contain enough explosive to form perforations 2124 through the second casing string 2106, the cement barrier 2108 and into the formation 2110. The bi-directional charges 2122 also contain enough explosive to form perforations 2126 through the first casing string 2104. In this manner, the bi-directional charges 2122 may be positioned to create a production flow path from the formation 2110 to an area inside the first casing string 2104. The production flow paths created by perforations 2120 and perforations 2124 maintain fluid communication with the area inside the first casing string 2104 through the perforations 2126 in the first casing string 2104.

Figure 21D:
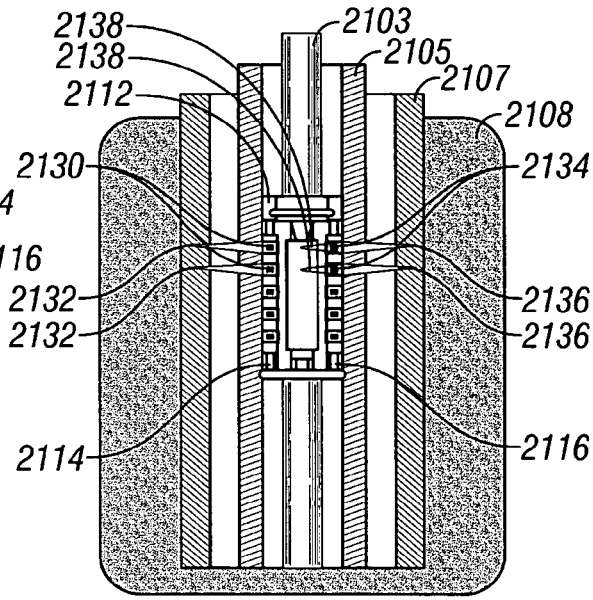
FIG. 21D is a partial cross-sectional view illustrating the application of limited entry bi-directional charges.

In FIG. 21D, the carrier 2112 is positioned on the production casing string 2103 at a predetermined depth. The production casing string 2103 is positioned within the intermediate casing string 2105, which is positioned within the surface casing string 2107. The production casing string 2103, intermediate casing string 2105, and surface casing string 2107 may be secured within the wellbore by the cement barrier 2108. The shaped charges 2130 in the first pressure chamber 2114 of the carrier 2112 contain just enough explosive to form limited perforations 2132 through the intermediate casing string 2105, and partially through the surface casing string 2107. In this manner, the shaped charges 2130 may be positioned to create a production flow path from inside the surface casing string 2107 to an area inside the intermediate casing string 2105. The bi-directional charges 2134 in the second pressure chamber 2116 contain just enough explosive to form limited perforations 2136 through the intermediate casing string 2105, and partially through the surface casing string 2107. The bi-directional charges 2134 also contain just enough explosive to form perforations 2138 through the production casing string 2103. In this manner, the bi-directional charges 2134 may be positioned to create a production flow path from inside the surface casing string 2107 to an area inside the production casing string 2103. The production flow paths created by limited perforations 2132 and limited perforations 2136 maintain fluid communication with the area inside the production casing string 2103 through the perforations 2138 in the production casing string 2103.

As illustrated by the various embodiments depicted in FIGS. 21A-D, bi-directional charges may be used in a variety of applications to perforate multiple casing strings. Moreover, bi-directional charges may be used to create various types of perforations at various radial positions extending from the carrier 2112.

Figure 6B:
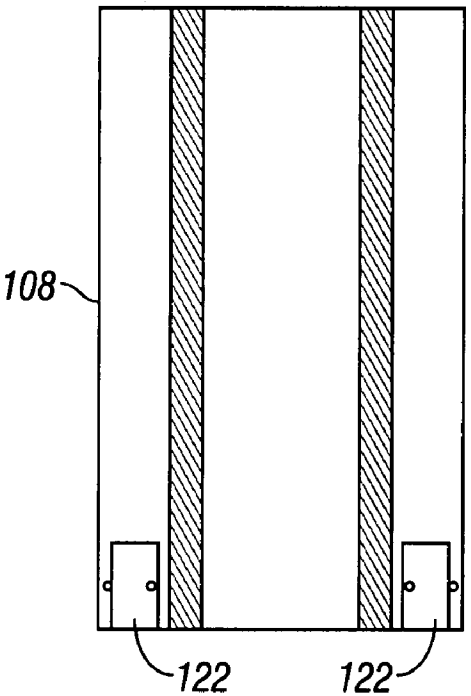
FIG. 6B is a partial cross-section of FIG. 6A along line 6B-6B illustrating inserted nipples that each carry a donor charge.
Figure 6A:
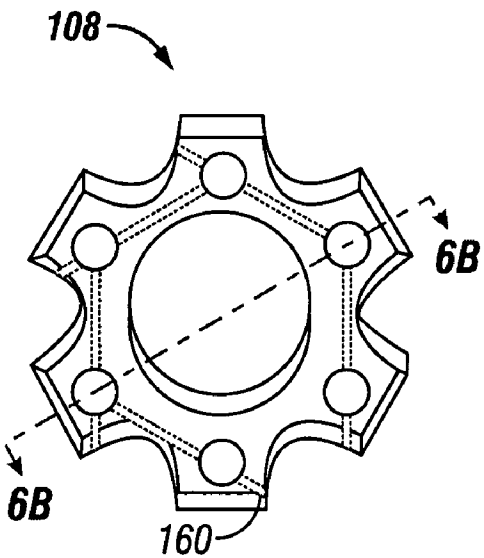
FIG. 6A is a cut view of the present invention illustrating the firing head.

Referring now to FIGS. 6A and 6B, a firing head 108 is provided, in one respect, to secure each pressure chamber 101 surrounding the casing 102. The firing head 108 is also used to detonate a booster charge 121 in each pressure chamber 101. The firing head 108 is a machined body that fits around the outside of the casing 102. The firing head 108 includes ports 160, fittings, and receptacles (not shown), which allow the installation of electrical devices and ballistic connections. The firing head 108 also includes a nipple 122 for each adjacent and longitudinally aligned pressure chamber 101. Each nipple 122 contains a ballistic transfer device (donor charge 104A in FIG. 7) for activating the booster charge 121. The firing head 108 may be secured to the casing 102 by any known means, such as grub screws, so that it cannot rotate or move laterally along the casing 102. The firing head 108 is normally metallic in nature and has a number of connection points for the admission of signals from a telemetry device at the surface of the formation.

The firing head 108 is controlled using a telemetry system. The telemetry system may comprise any known transmission means for transmitting signals from a control station outside the wellbore (not shown) to the electronic devices located in the firing head 108 and vice versa. The transmission means may accommodate signals that are electronic, electromagnetic, acoustic, seismic, hydraulic, optical, radio or otherwise in nature. The transmission means may comprise, for example, a device providing a continuous connection between the firing head 108 and the wellhead such as a cable 108A, a hydraulic control line, optical fiber, or the casing 102. The telemetry system also comprises a feed-through device (not shown) to allow the transmission means (cable 108A) to pass through the wellhead without creating a leak path for wellbore fluids under pressure. The cable 108A may be secured to the outside of the casing 102 to prevent damage while running the casing 102 in the wellbore.

A non-continuous transmission means for transmitting the detonating signals may also be used between modular applications of the present invention positioned longitudinally along the casing 102. For example, a non-electric detonating train comprising Nonal, or an equivalent material, may be used to initiate the detonation signal. The use of electrical or other continuous transmission means to detonate the shaped charges positioned in the several modular applications of the present invention (or to "back-up" a continuous transmission means) may result in a short-circuit caused by wellbore fluids thus, terminating any further detonation of the shaped charges. Thus, the use of a non-continuous transmission means to conduct the detonation process means that ingress from the wellbore fluids between modular applications of the present invention are non-terminal.

Figure 15A:
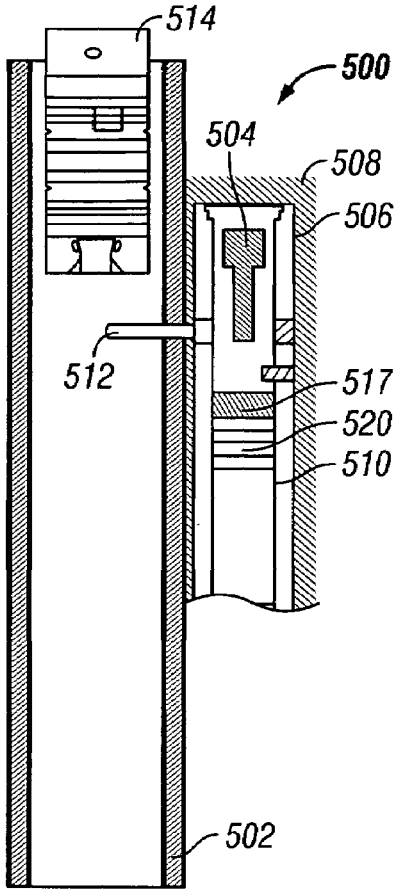
FIG. 15A is a partial cross-sectional view of a hydraulically activated firing head before activation.
Figure 15B:
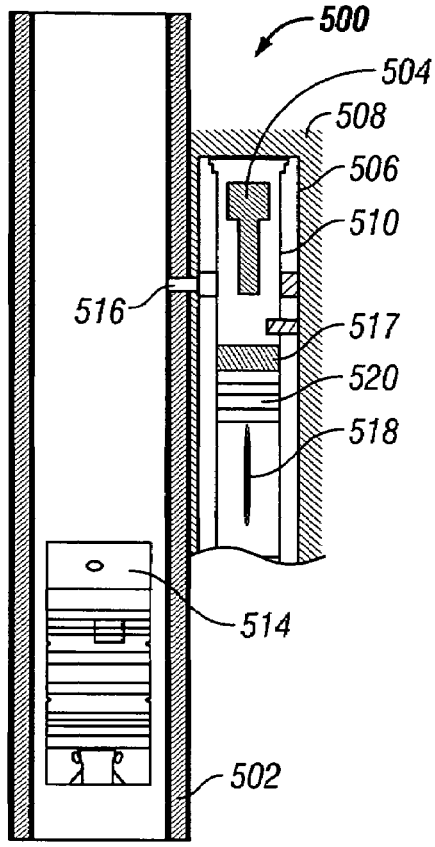
FIG. 15B is a partial cross-sectional view of the firing head illustrated in FIG. 15A after activation.

One embodiment of a non-continuous transmission system for transmitting a detonating signal to the firing head is illustrated in FIGS. 15A and 15B. This system utilizes hydraulics to activate the firing head through the application of hydraulic pressure within the casing 502. In FIG. 15A, a partial cross-sectional view of the firing head is illustrated just prior to activation. The firing head may comprise one or more firing units 510. The firing head therefore, may comprise many of the same electrical components described in reference to FIG. 7,except the detonating signal transmission means. For example, each firing unit may comprise the essential electrical components described in reference to FIG. 7, including the processing device 112, the power source 113, the high-voltage device 114, and the detonating device 107. The firing head includes a body 508 with one or more separate longitudinal chambers 506. Each chamber 506 may be used to isolate a respective firing unit 510 and protect it from external pressures. One or more shearable plugs 512 may be used to reduce or eliminate fluid communication between each respective firing unit 510 and the inside of casing 502. Additionally, the firing head body 508 may be integrally formed with a surface of casing 502 to further reduce or eliminate fluid communication between the wellbore and each firing unit 510.

A force plug 514, which may comprise cement or any other well-known composite material acceptable for use in a wellbore, may be used to break each shearable plug 512 as illustrated in FIG. 15B. The force plug 514 may be dropped through the casing 502 and/or propelled with any fluid in the casing 502. Once each shearable plug 512 is broken, a fluid path 516 is created between the inside of casing 502 and each respective firing unit 510 for the passage of pressurized wellbore fluids. A pressure switch (not shown) may be connected to the electronics 504 of each firing unit 510 and used to activate a detonating device 517 in a manner similar to that described in reference to FIG. 7. Upon application of a predetermined pressure from the wellbore fluids, the pressure switch may be activated. Once the detonating device 517 is activated, a donor charge 520 is ignited, causing an explosive discharge 518 that may be used to ignite a ring of detonating cord (not shown) and multiple other donor charges in the manner described in reference to FIGS. 6A-B and 7, and/or shaped charges in each gun assembly as described below in reference to FIG. 8.

Figure 16:
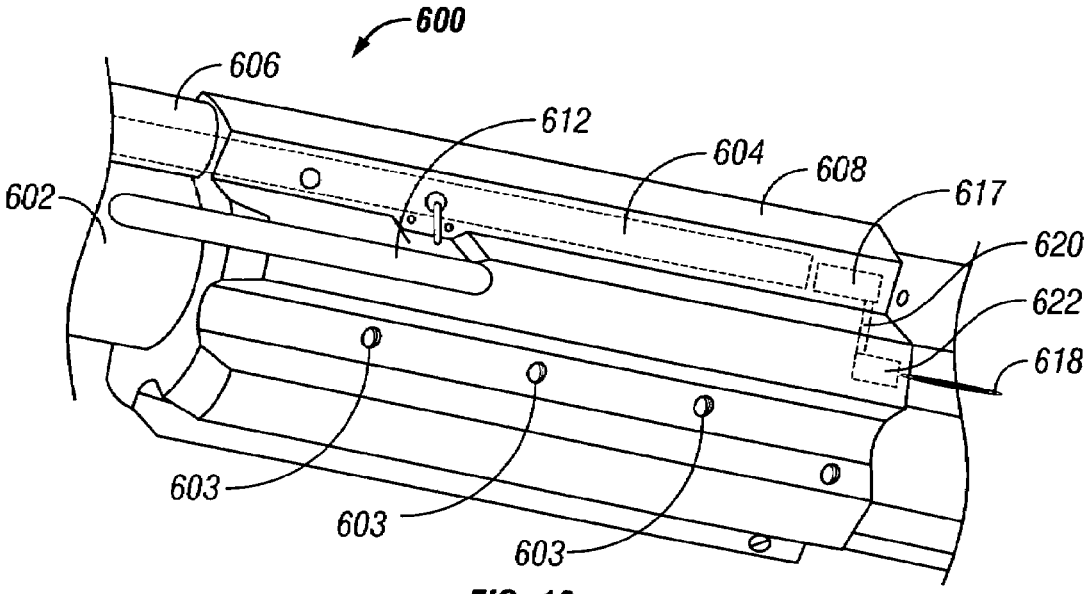
FIG. 16 is a perspective view of an electronically activated firing head.

Another embodiment of a non-continuous transmission system using wireless technology to transmit a detonating signal to the firing head is illustrated in FIG. 16. The firing head 600 includes a body 608 having a tubular passage therethrough. The tubular passage accepts receipt of a tubular housing 606. The tubular housing 606 contains an electronics package 604 in a sealed environment. The firing head 600 may be attached to the casing 602 by any conventional means, such as grub screws (not shown), which pass through the openings 603 in the body 608 and engage the casing 602. The electronics package 604 may include conventional electronics, like the components described in reference to FIG. 7, which are necessary to accept, process and transmit an acoustic signal from the surface. The acoustic signal from the surface is transmitted down through the casing 602. An antenna 612, which is connected to the electronics package 604, is used to intercept the acoustic signals traveling through the casing 602. Once the signal is intercepted by the antenna 612, the signal is processed in the manner described in reference to FIG. 7 for activating a detonating device 617, which may be an exploding bridge wire (EBW). The explosion from the detonating device 617 ignites detonating cord 620. Once the detonating cord 620 is ignited, one or more donor charges 622 connected to the detonating cord 620 are detonated. The detonation of each donor charge 622 creates an explosive discharge 618 that may be used to detonate the charges contained in a gun assembly as described further in reference to FIG. 8.

Regardless of whether continuous or non-continuous means are used for signal transmission, the telemetry system transmits signals at a power level that is insufficient to cause detonation of the detonating device or shaped charges.

Figure 7:
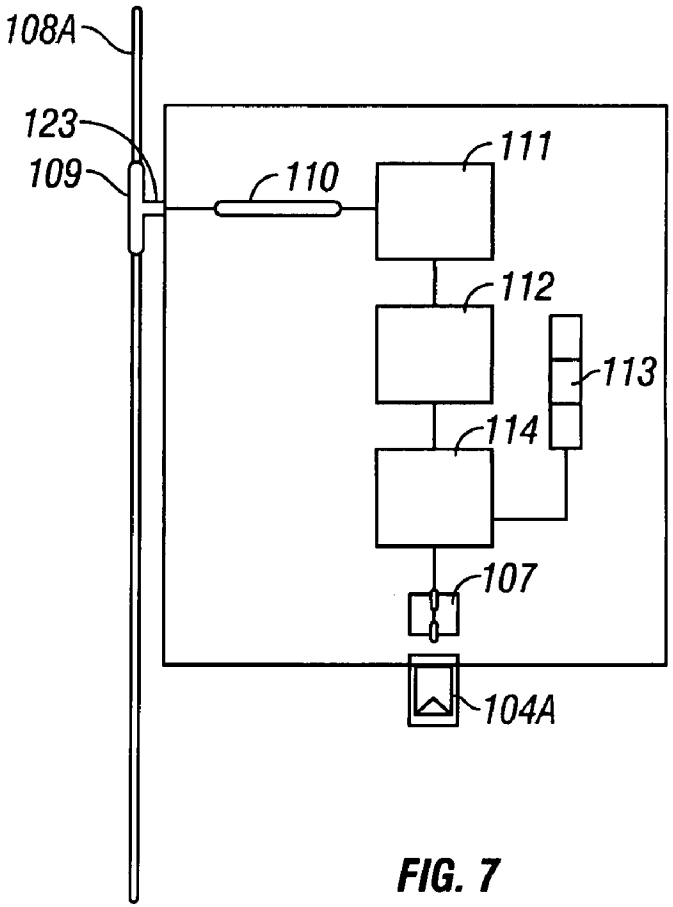
FIG. 7 is a schematic diagram illustrating the electrical components of the firing head.

A schematic diagram showing the electronic components of firing head 108 is provided in FIG. 7. The signal from the control station at the surface is transmitted, for example, through the cable 108A, an electrical connector 109 and an electronic connection point 123 to the firing head 108.

Electrical connector 109 is a device through which signals are transmitted to the connection point 123 and other electronic components within the firing head 108. The electrical connector 109 has at least two coaxial conductors and two or three terminations, forming either an elbow or T-piece configuration. The electrical connector 109 also provides continuity to each of the at least two conductors and each of the two or three termination points. The body of electrical connector 109 may be metallic or non-metallic in nature, being typically either steel or a durable composite (e.g., the composite known as "PEEK").

Besides electrical connector 109, other electronic components include a transmitter/receiver 111 for transmitting or receiving a signal to or from the surface, and an isolating device 110 to prevent short-circuit of the transmitter/receiver 111 after detonation of the firing head 108.

The isolating device 110 is used to isolate the electrical connector 109, to which it is attached, from any invasion of conductive fluids so that electrical continuity at and beyond the electrical connector 109 is maintained even though conductive fluids may have caused a short circuit at the isolating device 110. For example, electrical continuity through cable 108A is maintained after detonation of the firing head 108 because the isolating device 110 acts to electrically disconnect cable 108A from conductive wellbore fluids that enter the firing head 108 when increased pressure from the wellbore fluids is applied to the isolating device 110. Isolating device 110, and other devices used for similar purposes, are generally known in the art are and commercially available.

An electronic processing device 112 is also provided. The processing device 112 is used to interpret signals from the surface and then transmit signals back to the surface. The signals are recognized by the processing device 112 as matching a pre-programmed specification corresponding to a command to execute some pre-determined action. The processing device 112 comprises a microprocessor-based electronic circuit capable of discriminating with extremely high reliability between signals purposefully transmitted to it through the transmitter/receiver 111 and stray signals received from some other source. The processing device 112 is also capable of interpreting such signals as one or more instructions to carry out predetermined actions. The processing device 112 contains known internal devices that physically interrupt electrical continuity unless predetermined conditions are met. These internal devices may include a temperature switch, a pressure switch, or a timer. Once a particular condition is satisfied (e.g., a particular temperature, pressure, or the elapse of time) the internal device creates electrical continuity. Once continuity is achieved, the resulting electrical connection is used to initiate one or more pre-determined actions. These actions may include (i) initiating the firing of an electronic detonating device 107 via an electronic high-voltage device 114; (ii) the transmission of a coded signal back to the transmitter/receiver 111, the nature of which may be determined by the state of one or more variable characteristics inherent to the processing device 112; and/or (iii) the execution of an irreversible action such that the processing device 112 and/or high-voltage device 114 are rendered incapable of activating the detonating device 107. One embodiment of the processing device 112 is manufactured by Nan Gall Technology Inc. and can be easily modified to perform in the manner described above, such modifications being well within the knowledge of one skilled in the art.

The source of voltage necessary for activation of the detonating device 107 is drawn from a power source 113. Power source 113 comprises one or more electrical batteries capable of providing sufficient power to allow the electronic devices within the firing head 108 to function for the designed life of the system. The battery or batteries selected may comprise any number of known types (e.g., lithium or alkaline) and may be rechargeable, in a trickle-charge manner, via the transmitter/receiver 111.

The high-voltage device 114 is used to transform the low voltage supply provided by power source 113 (typically less than 10 volts) into a high-voltage spike (typically of the order 1000V, 200 A), within a few microseconds as appropriate for activation of the detonating device 107. Such a device is known to those skilled in the art as a "fire set" or "detonating set." The high-voltage device 114 is commercially available from Ecosse Inc.

The detonating device 107 is activated when the appropriate signals are transferred to the firing head 108 through electrical connector 109. After the processing device 112 interprets the detonation signals, a charge from the power source 113 is transmitted through the high-voltage device 114 to the detonating device 107.

Upon activation, the detonating device 107 generates a shock wave, on application of electrical voltage, of an appropriate waveform. The detonating device 107 typically comprises a wire or filament of known dimensions, which flash vaporizes upon application of sufficient voltage. One example of a detonator that may be used is referred to by those skilled in the art as an exploding bridge wire (EBW) detonator. Such detonators are typically packaged together with an electronic high-voltage device. Other kinds of detonators known to those skilled in the art may also be used.

The shaped charges 104 in each pressure chamber 101 may be detonated using a single detonating device 107 and a detonating cord similar to detonating cord 105. For example, the detonating device 107 activates a donor charge 104A that communicates with a detonating cord (not shown). The detonating cord is passed through ports 160 of the firing head 108 illustrated in FIG. 6A and communicates with a donor charge positioned in each respective nipple 122 of the firing head 108 illustrated in FIG. 6B. Thus, activation of the donor charge 104A detonates each donor charge in communication with the detonating cord. Ballistic transfer is then used to fire each pressure chamber 101 at the same depth or at different depths within the wellbore.

Figure 17:
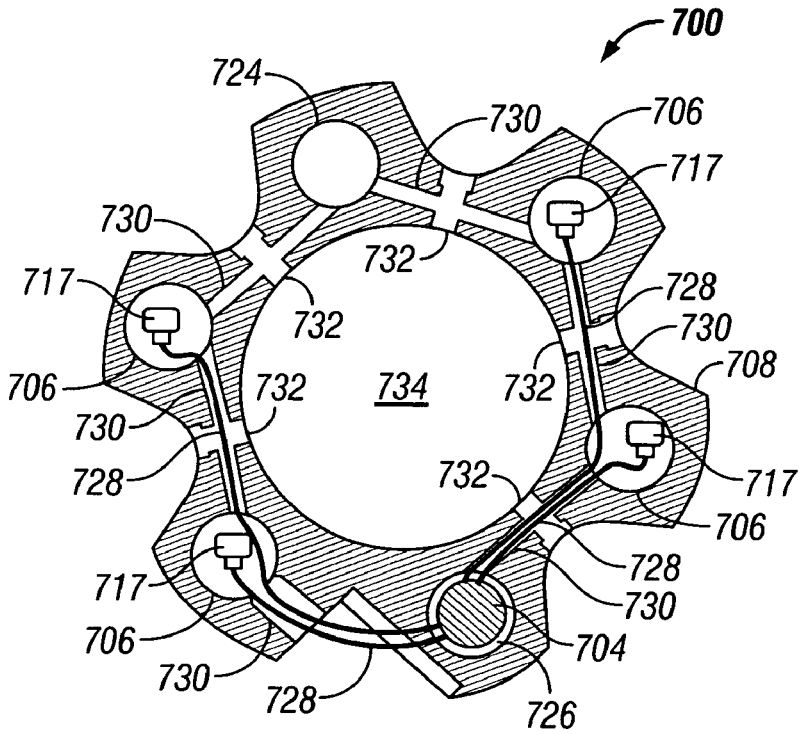
FIG. 17 is a cross-sectional view of another embodiment of an electronically activated firing head.

Alternatively, the detonating cord may be replaced with an electronic detonation transmission medium as illustrated in FIG. 17. For example, the use of a single detonating device and detonating cord to detonate multiple donor charges may be undesirable to the extent that the detonating cord malfunctions and/or simultaneous detonation of each donor charge in the firing head is preferred. In FIG. 17, the firing head 700 is capable of simultaneous detonation of each donor charge. Moreover, detonating device malfunctions may be isolated to prevent termination of otherwise functioning detonating devices. In order to achieve these results, the firing head 700 includes a firing head body 708 comprising multiple passages therethrough. The firing head body 708 may be manufactured from any well-known non-corrosive metal or metal alloy capable of withstanding the wellbore environment. Each passage 706 may be sealed to form a chamber for isolating a respective detonating device 717 from the wellbore. In this embodiment, the firing head 700 includes six chambers and four detonating devices. The firing head 700 therefore, includes one empty chamber 724 and a main chamber 726 for the electronics package 704. Alternative embodiments may employ additional or fewer chambers, depending on the desired number of detonating devices.

The electronics package 704 may comprise many of the same components that are described in reference to FIG. 7. Once the detonation signals are received and processed by the electronics package 704 from the surface, however, the electronics package 704 may activate each detonating device 717 connected thereto. Detonating wires 728 are each connected at one end to the electronics package 704, and pass through a respective port 730 to a corresponding detonating device 717 to which they are connected at the other end. Transverse openings 732 are provided for grub screws (not shown), which pass therethrough and secure the firing head 700 to the casing (not shown). The casing passes through the larger longitudinal opening 734 of the firing head 700. Because each detonating device 717 is connected to the electronics package 704 by an independent detonating wire 728, each detonating device 717 and corresponding donor charge (not shown) may be selectively (independently) activated or simultaneously activated with the other detonation devices and donor charges. The ability to selectively activate each detonating device 717 and corresponding donor charge also enables the selective detonation of the shaped charges used to perforate the formation. As a result, the firing head 700 may be used to selectively activate multiple gun assemblies as described in reference to FIG. 8. This ability to simultaneously activate each detonating device 717 and corresponding donor charge may reduce the shock waves and other associated stresses otherwise imposed on the firing head 700 and casing.

Referring now to FIG. 8, a first (upper) gun assembly 61 is in shock-wave communication with a second (lower) gun assembly 63. A receiver charge (not shown) positioned at the upper end of the first gun assembly 61 is activated by ballistic transfer of a shock wave from the explosion of a donor charge located adjacent the receiver charge in the nipple 122 of the firing head 108. Thus, the end cap 115 of each pressure chamber 101 is aligned with a corresponding nipple 122 of the firing head 108 in order to maintain a distance capable of ballistic transfer. Once the receiver charge is detonated in the pressure chamber containing the first gun assembly 61, the shaped charges 104 in FIG. 5 are detonated as the shock wave from each charge passes through the detonating cord 105 to the booster charge 121. The booster charge 121 at the lower end 60 of the first gun assembly 61 is axially aligned and separated by a known distance from an upper end 62 of the second gun assembly 63 containing a receiver charge 120. The axis of the gun assemblies 61 and 63 may be aligned so that the shock wave generated by the ignition of the first gun assembly 61 is transferred from the booster charge 121 to the receiver charge 120 in the second gun assembly 63. The use of booster charges and receiver charges in successive pressure chambers may be used to reliably allow the continued propagation of the detonation shock wave from the firing head 108 to an adjacent pressure chamber.

Figure 11A:
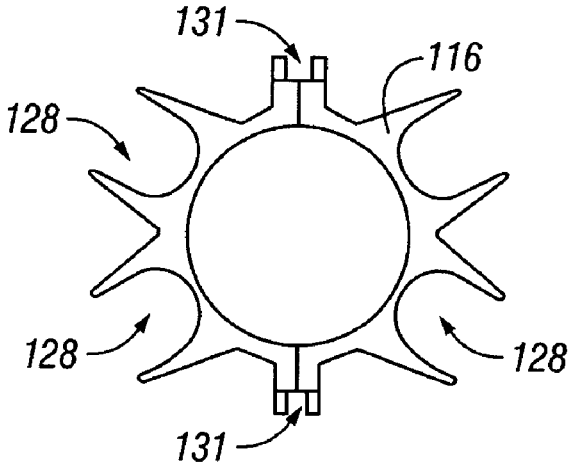
FIG. 11A is an end view of the carrier illustrated in FIG. 4 without pressure chambers.
Figure 11B:
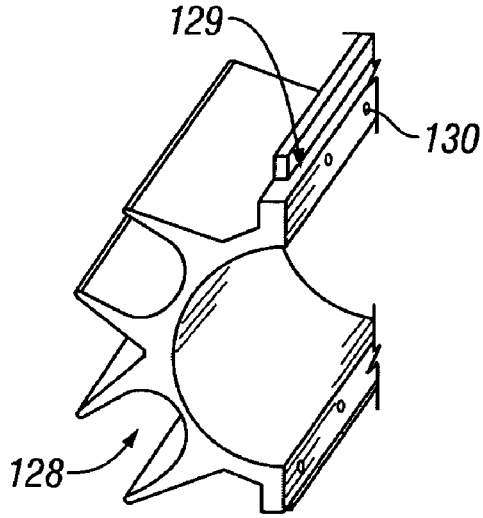
FIG. 11B is a partial perspective view of half of the carrier illustrated in FIG. 11A.

Referring now to FIGS. 11A and 11B, the carrier 116 is shown without the attached pressure chambers. Pre-formed channels 128 on the exterior of carrier 116 receive the tubular pressure chambers. Each carrier 116 comprises two hemi-cylindrical parts, like the one illustrated in FIG. 11B. Each half of the carrier is secured to the other half by bolts (not shown) that pass through bolt holes 130. Each half of the carrier 116 includes profiles 129 formed at either end to accommodate clamps 117, which are illustrated in FIG. 12. Once the carrier 116 is secured to the casing, a plurality of longitudinal canals 131 are defined by the structure of the carrier 116. The canals 131 create a protective space in which a continuous transmission medium, such as cable, control line or fiber optics, can be deployed. It is often desirable to deploy a cable or fiber optics along the length of a wellbore for connection to, or to act directly as, a sensing device. By deploying such items in the canals 131, they are kept away from any damage potentially caused by detonation of the shaped charges facing the casing or formation.

The carrier 116 may be constructed of metallic or non-metallic materials. The material used in the preferred embodiment is aluminum. The length of the carrier 116 is equal to that of the pressure chamber 101 and each end cap 115, allowing for a pre-determined separation between the end cap of one pressure chamber and the end cap of another pressure chamber mounted above or below it on the casing.

Figure 12A:
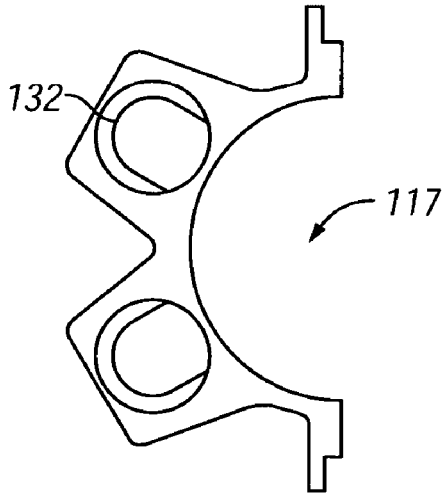
FIG. 12 A is an end view of a clamp used to secure the carrier to the casing.
FIG. 12B is a perspective view of the clamp illustrated in FIG. 12A.
Figure 12B:
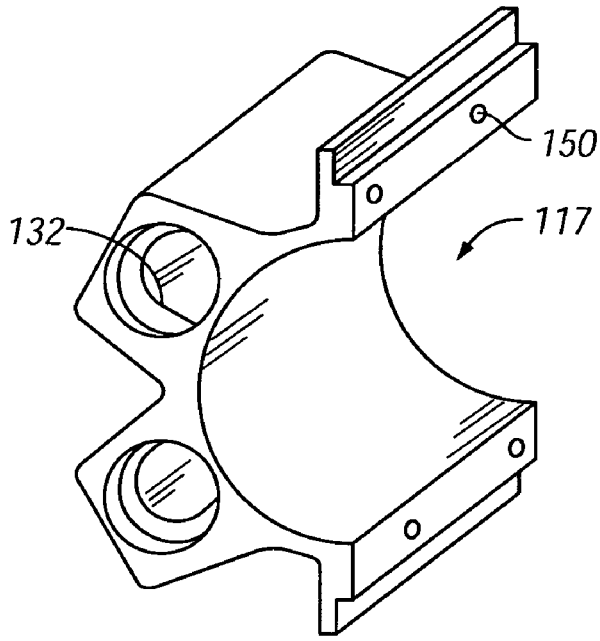

As shown in FIG. 12A and 12B, a pre-formed clamp is used for securing the carrier 116 and pressure chambers to the casing 102. Like the carrier 116, the clamp comprises two hemi-cylindrical parts like the one (117) illustrated in FIG. 12A. Each half of the clamp 117 is secured to the other half by bolts (not shown) that pass through bolt holes 150. The outer diameter of each half of the clamp 117, once made up on the casing 102, should be no greater than the outer diameter of the carrier 116.

The embodiments thus described, enable efficient and safe installation of the casing conveyed well perforating apparatus. First, the components are easily installed on the outside of the casing 102 as described above. Then the entire casing 102 is run in the wellbore. The present invention, therefore, is modular so that a large number of modules may be connected end to end, with ballistic transfer arranged from one module to the next module for perforation of long casing intervals. For shorter intervals, fewer modules may be used.

As these modules are run into the wellbore, the centralizing function of a modular perforating assembly is realized. Because the firing head 108, carrier 116 and pressure chambers 101 are equidistantly spaced and extend radially from the casing 102, the casing 102 may be centered within the wellbore. In other words, the modular assembly of one embodiment of the present invention is self-aligning as it is inserted into the wellbore. Because the casing 102 is centralized and not offset like conventional external perforating assemblies and/or insertion methods, the annular space between casing 102 and the wellbore is minimized. This minimization of annular space afforded by the present invention will either minimize wellbore diameters, maximize casing diameters, or both—resulting in reduced costs and increased productivity.

Once the casing 102 is properly positioned within the wellbore, cement is circulated into the annular space between the casing 102 and the wellbore by means generally well-known to those skilled in the art. The cement circulates freely through the space between the channels 128 separating each pressure chamber 101. Although circulation is not impaired by this embodiment, it could, however, be enhanced by a helical embodiment.

If the carrier 116 was formed in a helical shape, instead of longitudinally, as shown in FIGS. 4-12, it may induce turbulence when the cement is circulated through the space between the channels 128. Turbulence created by the circulating cement forces mud and other substances to the surface where they are preferably removed. Otherwise, when the cement hardens, the mud that has not been displaced will inhibit the formation of a seal between the casing 102 and the formation. Therefore, a carrier 116 and associated components forming a helical design may enhance the desired sealing properties of the cement.

Additionally, either design (longitudinal or helical) inherently reduces the amount of annular space between the casing 102 and the wellbore thus, placing the carrier 116 in closer proximity to the formation. Because this arrangement of charges requires less annular space between the casing 102 and the wellbore, less cement is required thus, further reducing costs. As a result, smaller charges are needed to perforate though the cement into the formation. As described further in reference to FIGS. 19A-C and 20, the use of an expandable tubular or casing also reduces the annular space between the casing and the wellbore, possibly eliminating the need to secure the casing or tubular with cement.

Additionally, once installed, each gun assembly 40 may be fired in any order. This is a significant advantage over the Snider system, which requires a bottom to top firing sequence. This is necessary because, with the Snider system, continuity is destroyed when the tool is activated. Such is not the case with the present invention, however. Because the modules of the present invention may be fired in any order, the user is able to access multiple formation zones during the life of the well.

For example, assuming three different formation zones at various depths within a wellbore, each formation zone may be selectively or simultaneously perforated using certain embodiments of the firing head and perforating devices, sometimes referred to as modules, comprising the present invention. A separate firing head and perforating device are required for each formation zone, except when the same are activated sequentially from the top down or the bottom up. In this exception, a single firing head may be positioned above the perforating devices to sequentially activate each perforating device from the top down, or the firing head may be positioned below the perforating devices to sequentially activate each perforating device from the bottom up. The firing head embodiments described in reference to FIGS. 6-7 may be used to simultaneously or selectively activate each perforating device assigned to a respective formation zone. The firing head embodiments described in reference to FIGS. 15 and 16, however, may only be used to sequentially activate each perforating device assigned to a respective formation zone. The firing head embodiment described in reference to FIG. 17 may be used to sequentially or selectively activate each perforating device assigned to a respective formation zone—provided it comprises a continuous detonating signal transmission medium like that described in reference to FIGS. 6-7.

Figure 18:
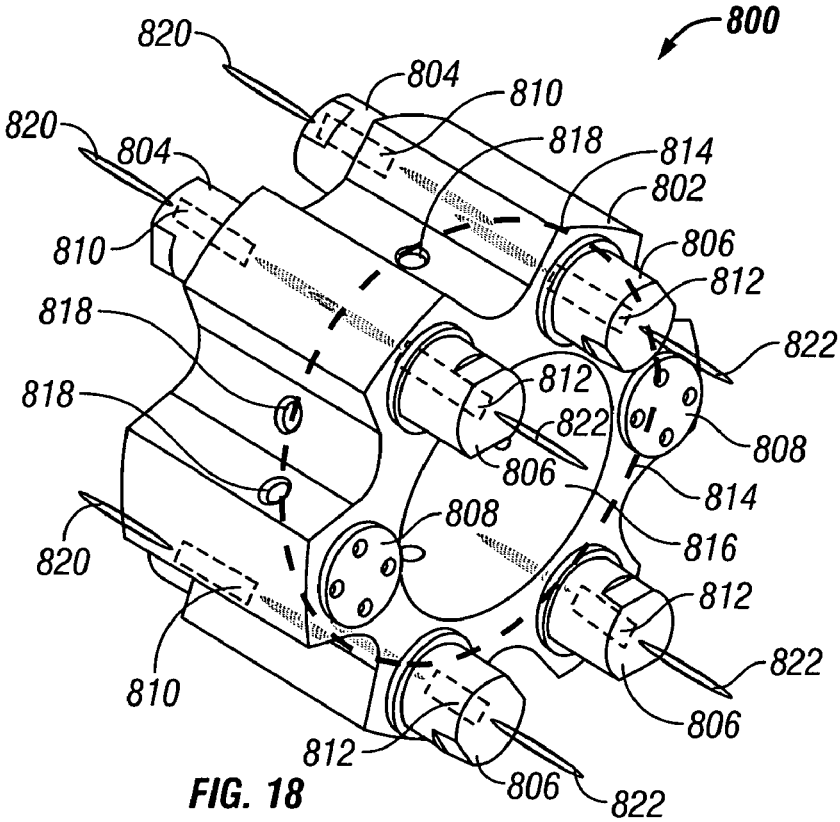
FIG. 18 is a perspective view of the present invention illustrating the booster ring.

In FIG. 18, a booster ring 800 may be positioned between each perforating device (not shown) in order to reduce the failure rate for each perforating device that may be due to interruptions in the transfer of ballistic energy. The booster ring 800 comprises a booster ring body 802, which may be manufactured from any well-known non-corrosive metal or metal alloy capable of withstanding the wellbore environment. The booster ring body 802 comprises multiple passages therethrough, which may be sealed to form separate chambers. In this embodiment, the booster ring 800 includes six sealed chambers. A nipple 804 is secured at one end of each of four chambers and another nipple 806 is secured at another end of each of the four chambers. Additional or fewer chambers and/or nipples may be preferred depending on the perforation needs. The remaining two chambers are each secured on their respective ends by an end cap 808. Each nipple 804, 806 holds a bi-directional donor charge 810 and 812, respectively. A detonating cord 814 may be positioned within an internal passage (not shown) circumscribing the booster ring body 802 for the transfer of ballistic energy from the respective detonation, and ensuing shock wave, of each donor charge 810, 812. The detonating cord 814 therefore, passes between each pair of opposing donor charges 810, 812. The booster ring body 802 also comprises an opening 816 therethrough for receipt of a casing segment.

Figure 22:
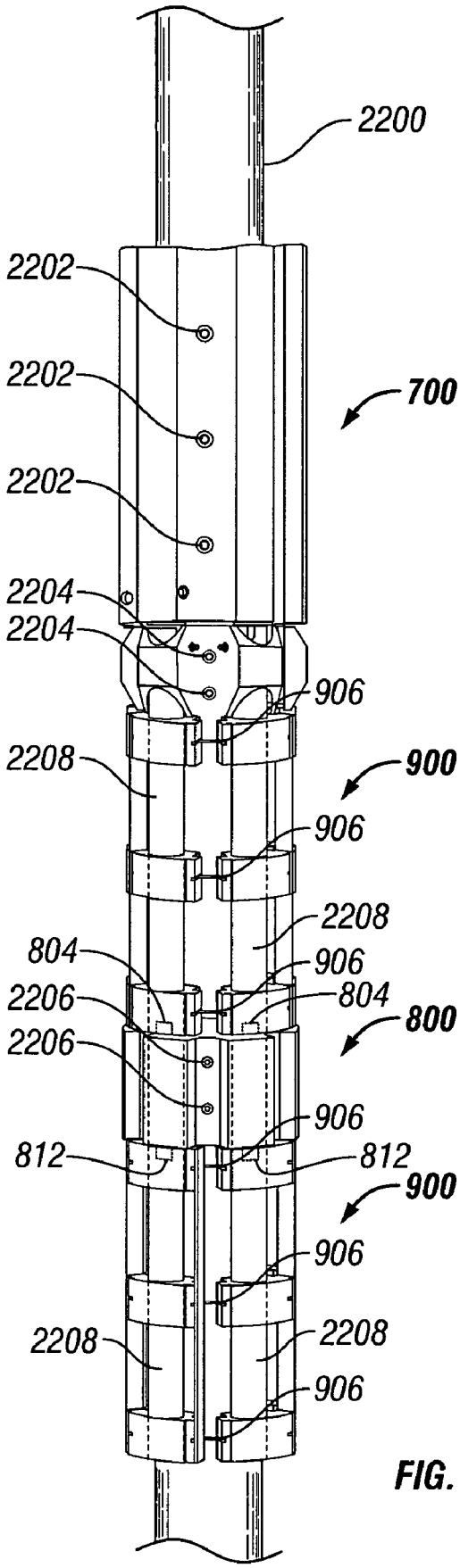
FIG. 22 is an elevational view illustrating one arrangement of the firing head, the carrier, the booster ring, and another carrier on a segment of casing.

As illustrated in FIG. 22, the booster ring 800 is secured to casing segment 2200 by a plurality of bolts 2206 that pass through corresponding openings 818 in the booster ring body 802 to reduce any lateral and longitudinal movement of the booster ring 800 on the casing segment 2200. The booster ring 800 may be positioned on the casing segment 2200 between two separate carriers 900 that are more fully described in reference to FIGS. 19A-B, however, may be constructed in the manner described in reference to FIG. 19C. The booster ring body 802 may be positioned so that each nipple 804, 806 is longitudinally aligned with a respective pressure chamber 2208 held in each carrier 900 above and below the booster ring 800, respectively. Each nipple 804, 806 is positioned sufficiently near the respective pressure chamber 2208 to transfer ballistic energy from the donor charges 810, 812 to a respective pressure chamber 2208. As ballistic energy propagates through a shock wave in the detonation cord 814, ballistic energy is transferred to each bi-directional donor charge 810, 812. Consequently, the detonation of each bi-directional donor charge 810, 812 transfers ballistic energy through each respective nipple 804, 806, resulting in shock waves 820and 822, respectively. Each shock wave 820 therefore, may detonate any undetonated booster charge in a pressure chamber 2208 positioned above each respective shock wave 820. Likewise, each shock wave 822 may detonate any undetonated receiver charge in a pressure chamber 2208 positioned below each respective shock wave 822. The booster charge in each pressure chamber 2208 positioned above the booster ring 800 and the receiver charge in each pressure chamber 2208 positioned below the booster ring 800 are, preferably, the charges located nearest the end of the respective pressure chamber 2208 that is nearest the booster ring 800.

In order for the booster charge located in each pressure chamber 2208 above the booster ring 800 to transfer ballistic energy through the remaining charges in the pressure chamber 2208, the booster charge must be bi-directional as illustrated by the donor charges 810, 812. Thus, the failure of the charges to detonate in any pressure chamber 2208 positioned on a carrier 900 above or below the booster ring 800 may be reduced. For example, if the charges in one of the pressure chambers 2208 positioned above the booster ring 800 on carrier 900 fail to detonate because the ballistic energy transferred from the firing head 700 did not reach the receiver charge, then the booster ring 800 provides a redundant system to detonate the charges from the bottom (booster) charge up to the receiver charge. Consequently, the booster ring 800 may be used in applications where there is no carrier 900 and therefore, no pressure chambers 2208 below the booster ring 800. If, however, there is a need for perforating multiple zones using multiple carriers 900 longitudinally positioned on the casing segment 2200, then the booster ring 800 reduces the occurrence of multiple detonation failures among charges located in pressure chambers 2208 that are longitudinally aligned with one another. For example, if the charges in one pressure chamber 2208 positioned above the booster ring 800 fail, the charges in another pressure chamber 2208 positioned below the booster ring 800, and longitudinally aligned with the pressure chamber 2208 above the booster ring 800, are provided another opportunity to detonate because they not only rely on the detonation of the charges in the failed pressure chamber 2208, but may also rely on the detonation of the donor charges 812 in the booster ring.

Of course, alternative embodiments not specifically identified above, but still falling within the scope of the present invention exist. For example, the pressure chamber 101 and carrier 116 illustrated in FIG. 4 may be formed as one integral component. Additionally, injection molding could be used to form the pressure chamber 101 and the carrier 116, while maintaining the features and functions described above. Resin transfer molding could also be used for the same purpose, as could any other comparable process for manufacturing solid bodies. Attaching the components housed in each pressure chamber 101 directly to the casing 102 could also be employed. For example, epoxy resin, or other similar material that cures into a hard solid, may be poured over and around such components within a pre-formed mold and attached to the casing 102 by means of any well-known industrial adhesive.

It is also possible that the present invention could be used equally well when the casing 102 is not secured by cement within the wellbore. When drilling certain hydrocarbon bearing formations, the invasion of drilling fluids into the formation causes significant damage to the near-wellbore region, impairing productivity. In situations where cementing and perforating the casing are undesirable, various means are used to avoid and/or remove such damage. For example, a pre-drilled or slotted liner may often be run in the wellbore to preserve its geometry and/or prevent ingress of formation material. The present invention provides a cost-effective way to bypass the damaged zone and perforate the desired formation without the use of cement.

Figure 19A:
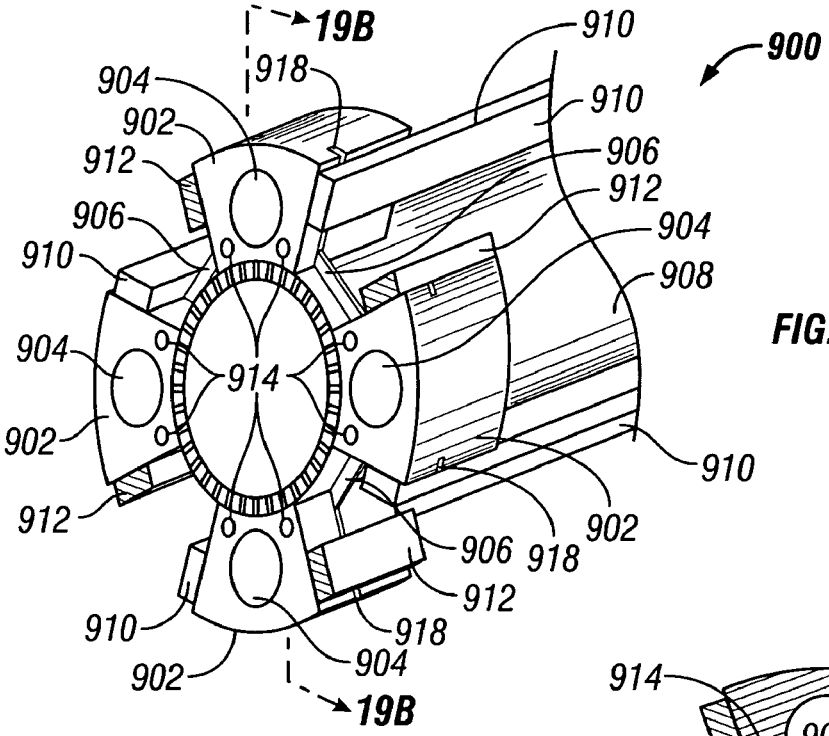
FIG. 19A is a partial perspective view of another embodiment of the carrier attached to a segment of casing.
Figure 19B:
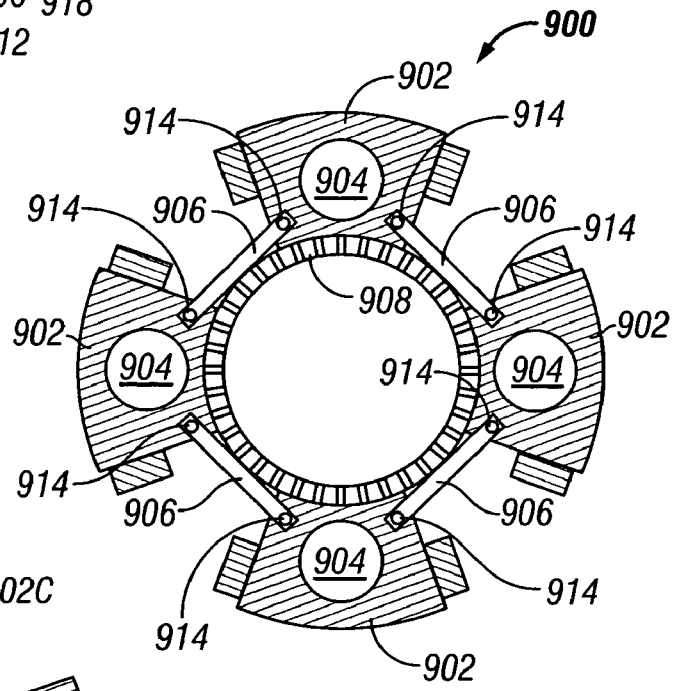
FIG. 19B is a cross-sectional view of FIG. 19A along line 19B-19B.

The carrier 900 in FIGS. 19A and 19B illustrate, for example, another embodiment that may be used in a wellbore with or without cement. The carrier 900 comprises a plurality of brackets 902. Each bracket 902 includes a tubular passage 904 for receipt of a perforating device (not shown). Each bracket 902 may be secured to another bracket 902 by one or more fasteners 906. Thus, the carrier 900 may be secured to a casing segment 908 by a plurality of fasteners 906, which may reduce radial and longitudinal movement of the carrier 900 on the casing segment 908. In order to further reduce longitudinal movement of the carrier 900 along the casing segment 908, a first longitudinal support bar 910 may be attached to one side of each bracket 902 at one end and to the same side of another bracket. Similarly, a second, shorter, longitudinal support bar 912 may be attached to another side of each bracket 902 at one end and to the same side of another bracket on another carrier to secure the carrier 900 to another carrier. The components comprising the carrier 900 may be manufactured from metal or other well-known metal alloys capable of withstanding wellbore conditions. Other well-known materials, however, may be used to construct the carrier 900, depending on the material costs and manufacturing concerns.

The carrier 900 may be made adjustable to fit any size casing segment 908 based upon the length of the fasteners 906. In this embodiment, each fastener 906 is releasably secured at each end to a bracket 902 by means of a rotatable roll pin 914, which passes through a corresponding opening (not shown) in the bracket 902 and a corresponding opening (not shown) in the fastener 906. Each bracket 902 also includes a groove 918 on opposite sides of the bracket 902 for receipt of a corresponding fastener 906. The carrier 900 therefore, may be made up in a continuous manner on the casing segment 908 as the casing segment 908 is being run into the wellbore. For example, the carrier 900 may be pre constructed so that only one end of one fastener 906 is loose. As each casing segment 908 is run in the wellbore, the carrier 900 may be secured to the casing segment 908 by simply inserting the last roll pin 914 through the openings in the appropriate bracket 902 and fastener 906. Depending on the diameter of the casing segment 908, a longer or shorter length fastener 906 may be used to make sure the carrier 900 fits securely on the casing segment 908.

Alternatively, the carrier 900 may be secured to the casing segment 908 by a plurality of ratchet-type fasteners (not shown) that enable longitudinal adjustment of the carrier 900 on the casing segment 908 and radial adjustment of the carrier 900 in the event that the casing segment 908 is expandable. For example, each end of each fastener 906 and corresponding groove 918 may be modified by means well-known in the art to include a plurality of opposing interlocking teeth so that the carrier 900 may expand radially as the casing segment 908 expands and still remain secured to the casing segment 908.

Figure 19C:
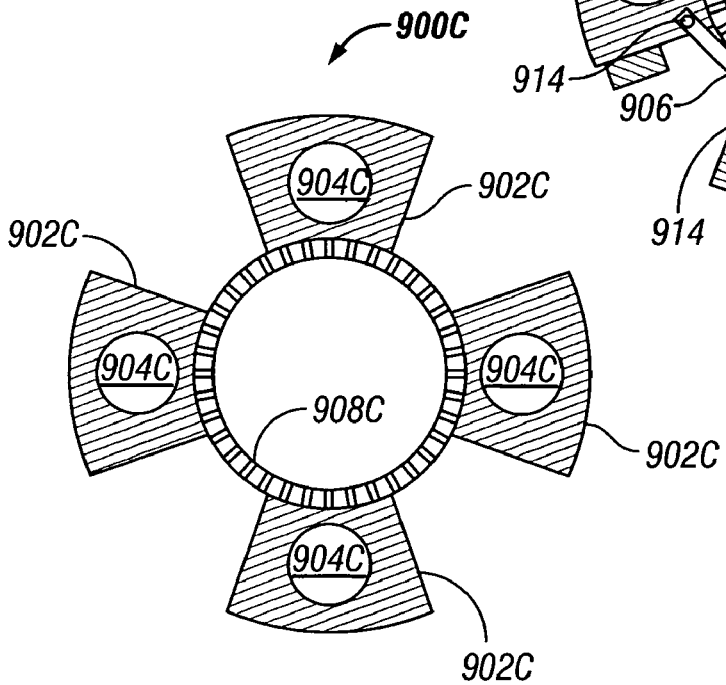
FIG. 19C is a cross-sectional side view of another embodiment of the carrier attached to a segment of casing.

In FIG. 19C, the carrier 900C illustrates yet another embodiment that may be used in a wellbore with or without cement. The carrier 900C comprises a plurality of brackets 902C integrally attached to a casing segment 908C. Each bracket 902C includes a tubular passage 904C for receipt of a perforating device (not shown). In this embodiment and the embodiment illustrated in FIGS. 19A and 19B, the casing segments 908 and 908C may be expandable, slotted and/or include a composite material. In addition, the carriers illustrated in FIGS. 4, 19A, 19B, and 19C may be attached to a casing string, production casing and/or any other type of downhole tubular in the manner described in reference to FIGS. 21A-D.

In the event that either embodiment of the carrier illustrated in FIGS. 19A, 19B or 19C is attached to an expandable casing segment, each perforating device held by the carrier may be activated by an independent firing assembly. The firing head described in reference to FIGS. 15A, 15B, 16 and 17 may therefore, be used on expandable casing with minor modifications.

The firing head may be modified by utilizing each of the firing head components in a separate housing or body for each perforating device. Each separate body may be attached to an expandable casing segment using the same carrier described in reference to FIGS. 19A, 19B and 19C, which is adjustable and/or expandable with the casing segment.

If the firing head is actuated by an electronic signal, or electronically actuated with a hydraulic assist, the electronic detonation signals may be communicated to each firing head body either through a downhole cable, which is linked to a surface communication system, or an antenna. The antenna may accept communications from a downhole cable terminated above the antenna, a wireless telemetry system, a signal carried through wellbore fluids and/or a signal carried through the tubular or casing segment. The cable from the surface or antenna transfers signals in the form of a wiring harness, which can expand without loss of communications as the casing segment expands. The wiring harness may be protected by an expandable wiring harness cage, or other well-known protection means, while running the antenna and other firing head components downhole in the wellbore with the casing. The wiring harness may include a junction box, which takes the detonation signal from the wiring harness to each separate firing head using an independent cable. Once the detonation signals are received by each individual firing head body, the signal is processed by an electronics package in the manner more fully described in reference to FIG. 16. The electronics package either detonates the donor charge or enables a hydraulic or mechanical system to detonate the donor charge.

Either embodiment of the carrier illustrated in FIGS. 19A, 19B or 19C may also be useful on expandable casing when one or more perforating devices are used to fire charges into the casing before it expands and to fire charges into the formation after the casing expands. In this manner, the charges may be placed more near the intended perforation area to reduce the size of the charge required. The charges may also be detonated through mechanical or hydraulic means that are well-known in the art and actuated by expansion of the casing and/or pressure from the formation contacting the perforating device as the tubular or casing expands toward the formation. The adjustable and/or expandable carrier embodiments thus described, enable uniform radial expansion of each perforating device as the casing expands.

Figure 20:
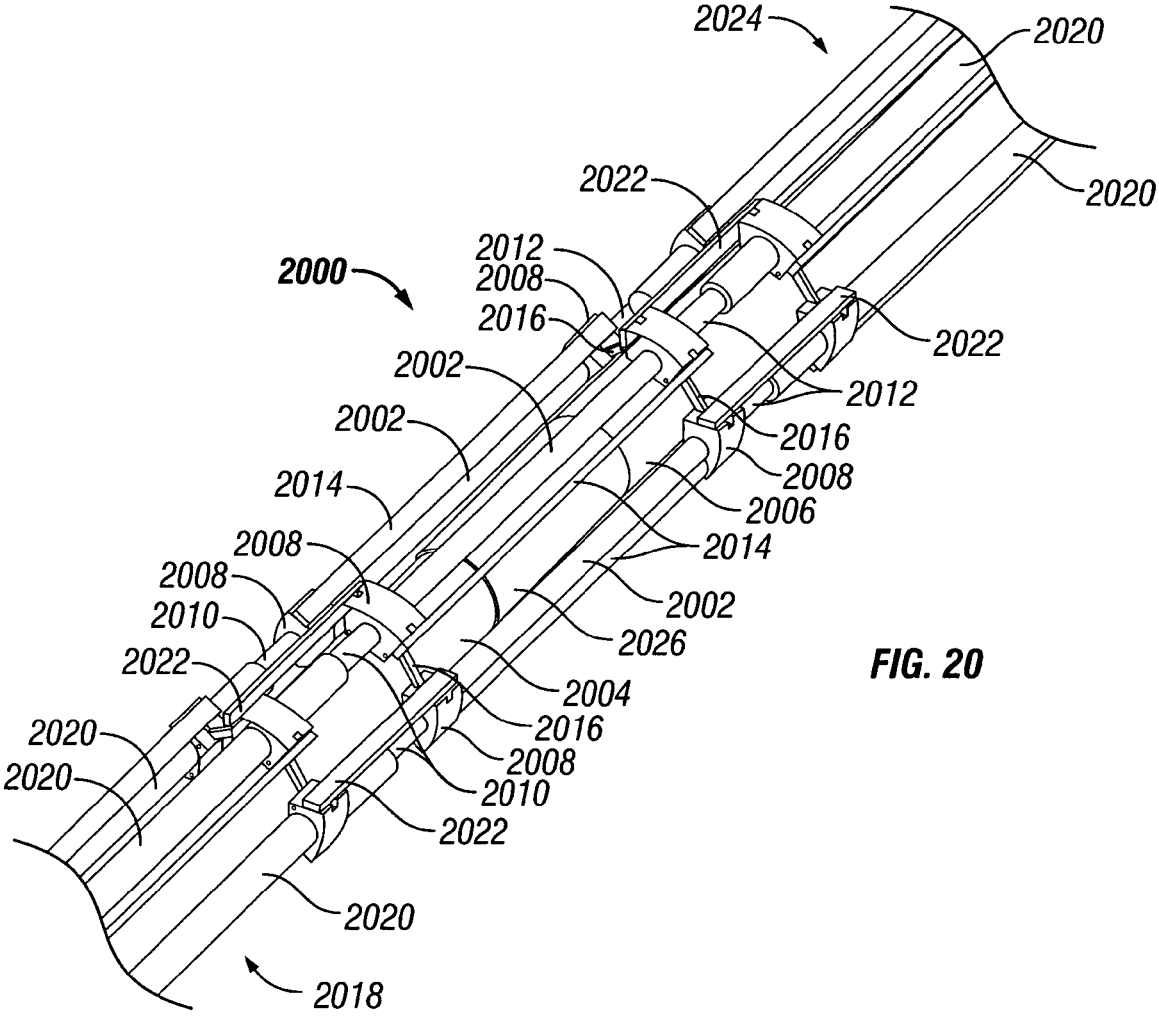
FIG. 20 is a partial perspective view of the present invention illustrating the cross-coupling assembly and two carriers attached to multiple casing segments.

Referring now to FIG. 20, a cross-coupling assembly 2000 is illustrated. The cross-coupling assembly 2000 comprises a plurality of isolated chambers 2002, each isolated chamber 2002 being secured in position relative to a first casing segment 2004 and a second casing segment 2006 by one or more brackets 2008. Each isolated chamber 2002 further comprises a first ballistic charge (not shown) positioned in a first end 2010 of the isolated chamber 2002 and a second ballistic charge (not shown) positioned in a second end 2012 of the isolated chamber 2002. A detonating medium (not shown) may be used to connect the first ballistic charge and the second ballistic charge within each isolated chamber 2002. Prima cord is preferably used as the detonating medium to transfer ballistic energy from the first ballistic charge to the second ballistic charge within each isolated chamber 2002.

A first longitudinal support bar 2014 may be attached to the brackets 2008 securing each isolated chamber 2002 for stability. A plurality of fasteners 2016 are used to releasably secure the cross coupling assembly 2000 to the first casing segment 2004 and the second casing segment 2006 in the same manner described in reference to FIGS. 19A and 19B. Thus, each bracket 2008 and each first longitudinal support bar 2014 are constructed and operate in the same manner as described in reference to FIGS. 19A and 19B.

A carrier 2018, constructed in the manner described in reference to FIGS. 19A and 19B, may be positioned on the first casing segment 2004 near the first end 2010 of each isolated chamber 2002. A second longitudinal support bar 2022 may be used to connect the carrier 2018 with the cross-coupling assembly 2000 and align each perforating device 2020 with the first end 2010 of each respective isolated chamber 2002. In this manner, a booster charge (not shown) may be positioned within one end of each respective perforating device 2020 nearest the first end 2010 of a respective isolated chamber 2002 for transferring ballistic energy to the first ballistic charge positioned in the first end 2010 of the respective isolated chamber 2002. Spacing requirements between the booster charge and the first ballistic charge may depend on the size of each respective charge and what material, if any, lies therebetween. Surface testing has confirmed that separation of about one half inch is acceptable when standard donor charges used in tubing-conveyed perforating operations are separated by only the end caps covering the respective charges.

Another carrier 2024, also constructed in the manner described in reference to FIGS. 19A and 19B, may be positioned on the second casing segment 2006 near the second end 2012 of each isolated chamber 2002. A second longitudinal support bar 2022 may be used to connect the another carrier 2024 with the cross coupling assembly 2000 in the line each perforating device 2020 with the second end 2012 of each respective isolated chamber 2002. In this manner, a receiver charge (not shown) may be positioned within one end of each respective perforating device 2020 nearest the second end 2012 of a respective isolated chamber 2002 for transferring ballistic energy from the second ballistic charge positioned in the second end 2012 of the respective isolated chamber 2002,to the remaining charges in the perforating device. Spacing requirements between the receiver charge and the second ballistic charge may depend on the size of each respective charge and what material, if any, lies therebetween. As mentioned, surface testing has confirmed that separation of about one half inch is acceptable when standard donor charges used in tubing-conveyed perforating operations are separated by only the end caps covering the respective charges.

The cross-coupling device 2000 therefore, is capable of transferring ballistic energy from each perforating device 2020 on the carrier 2018 to each corresponding perforating device 2020 on the another carrier 2024 over a threaded coupling connecting the first casing segment 2004 and the second casing segment 2006, which form a casing joint 2026. In other words, the cross-coupling assembly 2000 provides a continuous, uninterrupted medium through which ballistic energy may be seamlessly transferred from one carrier 2018 to the another carrier 2024 over connected tubulars or casing segments. The cross coupling assembly 2000 achieves this result by aligning each isolated chamber 2002 with a respective perforating device 2020 at substantially the same radial distance from an axis common to the first casing segment 2004 and the second casing segment 2006.

Referring now to FIG. 22, a casing segment 2200 is illustrated with the firing head 700, the booster ring 800 and two carriers 900 positioned thereon. An upper portion of the firing head 700 is secured to the casing segment 2200 by a plurality of bolts 2202 that pass through the firing head 700 and contact a surface of the casing segment 2200 to secure the upper portion of the firing head from movement on the casing segment 2200. Similarly, a lower portion of the firing head may be secured to the casing segment 2200 by a plurality of bolts 2204 that pass through corresponding openings in the firing head 700 and contact a surface of the casing segment 2200 to prevent movement of the lower portion of the firing head on the casing segment 2200. A booster ring 800 may be positioned on the casing segment 2200 below the firing head 700 and secured to the casing segment 2200 by a plurality of bolts 2206 that pass through corresponding openings in the booster ring 800 and contact a surface of the casing segment 2200 to prevent movement of the booster ring 800 on the casing segment 2200. A carrier 900 may also be secured above and below the booster ring 800 on the casing segment 2200 by a plurality of fasteners 906. Each carrier 900 may also be secured, in part, by the booster ring 800, which may reduce longitudinal movement of each carrier 900 on the casing segment 2200. Each carrier 900 preferably includes a plurality of perforating devices 2208 for perforating a subterranean-earth formation through a wellbore. Each perforating device 2208 may be aligned with the firing head 700 and the booster ring 800 to enable the transfer of ballistic energy.

The components illustrated in FIG. 22 thus, illustrate an efficient, redundant, external perforating system that may effectively perforate multiple formation zones at different depths in a wellbore, in any order. Furthermore, the components illustrated in FIG. 22 are also capable of perforating a particular zone of the formation in any direction circumscribing the casing segment 2200. The present invention therefore, provides an improved external perforating system for perforating and/or stimulating select formation zones.

Although the invention has been described with reference to the preferred embodiments illustrated in the attached drawing figures, and described above, it is noted that substitutions may be made and equivalents employed herein without departing from the scope of the invention.

The invention claimed is:

1. A firing head for activating a perforating device capable of perforating a subterranean-earth formation through a wellbore, the perforating device comprising a plurality of gun assemblies, each gun assembly comprising a plurality of explosive charges, the firing head comprising:

a body comprising a plurality of longitudinal passages there through, at least one of said longitudinal passages being a mounting passage for receipt of a tubular object;

at least one gun assembly comprising at least a first charge that is configured to perforate said tubular object in said mounting passage upon detonation and a second charge that is configured to not perforate said tubular object in said mounting passage upon detonation;

a plurality of donor charges, each donor charge secured within one of said longitudinal passages and positioned near a respective gun assembly; and a firing assembly for detonating the plurality of donor charges, the detonation of each donor charge creating ballistic energy that is transferred to a receiver charge in an another gun assembly for detonating the plurality of explosive charges contained therein.

2. The apparatus of claim 1, wherein each gun assembly is contained within a sealed pressure chamber for isolating the gun assembly from the wellbore.

3. The apparatus of claim 1, wherein the plurality of explosive charges comprise a receiver charge coupled to a booster charge, the receiver charge being positioned near a respective donor charge for accepting the ballistic energy and transferring the ballistic energy to the booster charge.

4. The apparatus of claim 1, further comprising a nipple for securing each donor charge within the respective longitudinal passage, each nipple being threadably connected to one end of the respective longitudinal passage.

5. The apparatus of claim 1, wherein the firing assembly is activated by a detonation signal from a surface of the formation, the detonation signal selected from the group of signals comprising: electronic, electromagnetic, acoustic, seismic, hydraulic, optical or radio frequency.

6. The apparatus of claim 5, further comprising a shearable plug positioned through a wall of the tubular object and the body of the firing head, the firing assembly being activated by hydraulic pressure from inside the tubular object when a force plug shears the shearable plug, creating a fluid path between the tubular object and the fining assembly.

7. The apparatus of claim 5, wherein the detonation signal is transmitted from the surface of the formation to the firing assembly through one of at least a continuous and non-continuous transmission medium.

8. The apparatus of claim 7, wherein the firing assembly comprises a transmitter/receiver for receiving the detonation signal from the surface and transmitting information back to the surface from the firing assembly.

9. The apparatus of claim 8, wherein the firing assembly comprises an isolating device positioned between the transmission medium and the transmitter/receiver for isolating the transmission medium from conductive fluids entering the firing assembly.

10. The apparatus of claim 9, wherein the firing assembly comprises a processor for interpreting the detonation signal.

11. The apparatus of claim 10, wherein the firing assembly comprises a detonator for each donor charge, the detonator being electronically coupled to the transmitter/receiver.

12. The apparatus of claim 11, wherein the detonator is an exploding bridge wire device.

13. The apparatus of claim 11, wherein each donor charge may be selectively activated.

14. The apparatus of claim 13, wherein each donor charge may be simultaneously activated.

15. An apparatus for transferring ballistic energy from a perforating device to another perforating device, the perforating device and the another perforating device each comprising a gun assembly, each gun assembly comprising a plurality of explosive charges, the apparatus comprising:

a body comprising a plurality of longitudinal passages there through, at least one of said longitudinal passages being a mounting passage for receipt of a tubular object;

at least one gun assembly comprising at least a first charge that is configured to perforate said tubular object in said mounting passage upon detonation and a second charge that is configured to not perforate said tubular object in said mounting passage upon detonation; a donor charge secured within one of the plurality of longitudinal passages, the donor charge being positioned near the gun assembly of the perforating device;

another donor charge being positioned near the gun assembly of the another perforating device; and a detonating medium for transferring the ballistic energy from the donor charge to the another donor charge.

16. The apparatus of claim 15, wherein each gun assembly is secured within a sealed chamber.

17. The apparatus of claim 15, wherein each plurality of explosive charges comprises a receiver charge and a booster charge.

18. The apparatus of claim 17, wherein the donor charge, the another donor charge, the receiver charge and the booster charge are bi-directional.

19. The apparatus of claim 18, further comprising a nipple for securing the donor charge within one of the plurality of longitudinal passages and another nipple for securing the another donor charge within at least one of the one of the plurality of longitudinal passages and the another one of the plurality of longitudinal passages.

20. The apparatus of claim 18, wherein donor charge is positioned about one-half inch (½") from at least one of the booster charge and the receiver charge for the perforating device.

21. The apparatus of claim 18, wherein the another donor charge is positioned about one-half inch (½") from at least one of the receiver charge and the booster charge for the another perforating device.

22. The apparatus of claim 15, wherein the detonating medium comprises a detonating cord.

23. The apparatus of claim 15, wherein the donor charge is positioned opposite the another donor charge relative to the detonating medium in the one of the plurality of longitudinal passages.

24. The apparatus of claim 15, wherein the another donor charge is positioned in another one of the plurality of longitudinal passages on the same side of the detonating medium as the donor charge.

25. A method for transferring ballistic energy from a first perforating device to a second perforating device, the first perforating device and the second perforating device each comprising a plurality of gun assemblies, each gun assembly comprising a plurality of explosive charges, the method comprising the steps of:

a) detonating one of the plurality of explosive charges in each gun assembly of the first perforating device; and b) transferring ballistic energy from the explosive charge detonated in step a) to at least one other explosive charge;

wherein at least one gun assembly is mounted on a tubular object and comprises at least a first charge that is configured to perforate the tubular object upon detonation and a second charge that is configured to not perforate the tubular object upon detonation.

* * * * *